US008197046B2

(12) United States Patent
Asami

(10) Patent No.: US 8,197,046 B2
(45) Date of Patent: Jun. 12, 2012

(54) INK-JET PRINTER

(75) Inventor: Keiichi Asami, Tokyo (JP)

(73) Assignee: Riso Kagaku Corporation, Tokyo (JP)

( * ) Notice: Subject to any disclaimer, the term of this patent is extended or adjusted under 35 U.S.C. 154(b) by 327 days.

(21) Appl. No.: 12/645,995

(22) Filed: Dec. 23, 2009

(65) Prior Publication Data

US 2010/0177148 A1 Jul. 15, 2010

(30) Foreign Application Priority Data

Jan. 9, 2009 (JP) ..... 2009-004081

(51) Int. Cl.
*B41J 2/175* (2006.01)

(52) U.S. Cl. ..... 347/89

(58) Field of Classification Search ..... 347/85, 347/89

See application file for complete search history.

(56) References Cited

U.S. PATENT DOCUMENTS 6,371,607 B2 * 4/2002 Wouters et al. ..... 347/89
6,443,560 B1 * 9/2002 Okano et al. ..... 347/55
6,742,882 B2 * 6/2004 Nakamura ..... 347/89
7,901,063 B2 * 3/2011 Wouters et al. ..... 347/89

FOREIGN PATENT DOCUMENTS

JP 2005-125670 A 5/2005

* cited by examiner

*Primary Examiner* — Anh Thi Ngoc Vo

(74) *Attorney, Agent, or Firm* — Holtz, Holtz, Goodman & Chick, PC

(57) ABSTRACT

In an ink-jet printer of the present invention, an ink circulation path 4 is formed by an ink head 2, a first tank 31, a second tank 32, and a pump 33. The ink-jet printer switches between an ink-circulation state and a no ink-circulation state during a printing operation, and is capable of performing printing in either of the states.

17 Claims, 12 Drawing Sheets

| | EXAMPLE 1 (R2<R1) | EXAMPLE 2 (R1=R2) | EXAMPLE 3 (P1=-P2) | EXAMPLE 4 (P1=-P2) AND (R1=R2) | EXAMPLE 5 (P1=-P2=-P3) |
|---|---|---|---|---|---|
| P1[kPa] | 2.0 | 1.7 | 1.0 | 1.0 | 1.0 |
| P2[kPa] | -1.0 | -1.0 | -1.0 | -1.0 | -1.0 |
| P3[kPa] | -1.5 | -2.7 | -4.0 | -2.0 | -1.0 |
| R2/R1 | 0.5 | 1.0 | 2.0 | 1.0 | 0.5 |
| NOZZLE INTERNAL PRESSURE IN INK-CIRCULATION PERIOD[kPa] | -1.0 | -1.0 | -1.0 | -1.0 | -1.0 |
| NOZZLE INTERNAL PRESSURE IN NO INK-CIRCULATION PERIOD[kPa] | -1.0 | -1.0 | -1.0 | -1.0 | -1.0 |

FIG. 4

| | | STATE OF LIQUID LEVEL DETECTION UNIT 45 | |
|---|---|---|---|
| | | ON | OFF |
| STATE OF LIQUID LEVEL DETECTION UNIT 42 | ON | PUMP 33 : OFF<br>SUPPLY VALVE 63 : OFF | PUMP 33 : OFF<br>SUPPLY VALVE 63 : OFF |
| | OFF | PUMP 33 : ON<br>SUPPLY VALVE 63 : OFF | PUMP 33 : OFF<br>SUPPLY VALVE 63 : ON |

F I G. 9

| | EXAMPLE 6 (P1=0) | EXAMPLE 7 (P1=0) |
|---|---|---|
| P1[kPa] | 0.0 | 0.0 |
| P2[kPa] | -1.0 | -1.0 |
| P3[kPa] | -2.0 | -1.0 |
| R2/R1 | 2.0 | 1.0 |
| NOZZLE INTERNAL PRESSURE IN INK-CIRCULATION PERIOD [kPa] | -1.0 | -1.0 |
| NOZZLE INTERNAL PRESSURE IN NO INK-CIRCULATION PERIOD [kPa] | -1.0 | -1.0 |

| | EXAMPLE 8 (P0>0) | EXAMPLE 9 (P0>0) |
|---|---|---|
| P0[kPa] | 2.0 | 2.0 |
| P1[kPa] | -1.0 | -0.5 |
| P2[kPa] | -1.0 | -1.0 |
| P3[kPa] | -2.0 | -2.5 |
| R2/R1 | 1.0 | 1.0 |
| NOZZLE INTERNAL PRESSURE IN INK-CIRCULATION PERIOD [kPa] | -1.0 | -1.0 |
| NOZZLE INTERNAL PRESSURE IN NO INK-CIRCULATION PERIOD [kPa] | -1.0 | -1.0 |

INK-JET PRINTER

CROSS REFERENCE TO RELATED APPLICATION

This application is based upon and claims the benefit of priority from the prior Japanese Application No. 2009-004081, filed Jan. 9, 2009, the entire contents of which are incorporated herein by reference.

BACKGROUND OF THE INVENTION

1. Field of the Invention

The present invention relates to an ink-jet printer being capable of performing image recording either in an ink-circulation period or in a no ink-circulation period.

2. Description of the Related Art

An ink-jet printer performs recording on a recording medium such as paper and the like by discharging ink drops from a plurality of nozzles of an ink head. In such an ink-jet printer, if air bubbles exist in the ink head, the nozzles cannot discharge ink stably, and an image-printing quality deteriorates as a result.

Therefore, for example, in an ink-jet printer disclosed in Japanese Laid-open Patent Publication 2005-125670, an ink circulation path is formed by a recording head, an ink room disposed lower than the recording head, a pump delivering ink in the ink room to the recording head, and a pipe connecting the recording head, the ink room and the pump. Then, in the ink-jet printer disclosed in Japanese Laid-open Patent Publication 2005-125670, the ink in the ink circulation path circulates while preventing ink leakage from the nozzle. Accordingly, air bubbles entrapped in the recording head and in the vicinity of the recording head are removed.

SUMMARY OF THE INVENTION

A ink-jet printer according to the present invention comprises an ink circulation path comprising an ink head having a nozzle face on which a plurality of nozzles are formed and discharging an ink from the nozzles in accordance with an image signal to perform a printing process on a recording medium; a first tank disposed so that a liquid level of ink stored in the first tank is on a same level as, or higher than, the nozzle face of the ink head in a gravitational direction, and being able to communicate with an atmosphere or to be shut off from the atmosphere; a second tank disposed so that a liquid level of ink stored in the second tank is lower than the nozzle face of the ink head in the gravitational direction, and being able to communicate with the atmosphere or to be shut off from the atmosphere; and a pump sending the ink in the second tank to the first tank; a pressure adjustment unit applying, when the second tank is shut off from the atmosphere, a negative pressure to the second tank, wherein the ink circulation path makes the first tank communicate with the atmosphere and shuts off the second tank from the atmosphere in an ink-circulation state period in which the ink is circulated, and shuts off the first tank from the atmosphere and makes the second tank communicate with the atmosphere in a no ink-circulation state period in which the ink is not circulated; and during the printing process, the ink-circulation state and the no ink-circulation state are switched.

Meanwhile, a ink-jet printer according to the present invention comprises an ink circulation path comprising an ink head having a nozzle face on which a plurality of nozzles are formed and discharging an ink from the nozzles in accordance with an image signal to perform a printing process on a recording medium; a first tank disposed so that a liquid level of ink stored in the first tank is lower than the nozzle face of the ink head in a gravitational direction, and being able to communicate with an atmosphere or to be shut off from the atmosphere; a second tank disposed so that a liquid level of ink stored in the second tank is lower than the nozzle face of the ink head in the gravitational direction, and being able to communicate with the atmosphere or to be shut off from the atmosphere; and a pump sending the ink in the second tank to the first tank; a pressure application unit applying, when the first tank is shut off from the atmosphere, a positive pressure to an inside of the first tank; and a pressure adjustment unit applying, when the second tank is shut off from the atmosphere, a negative pressure to the second tank, wherein the ink circulation path shuts off the first tank from the atmosphere and shuts off the second tank from the atmosphere in an ink-circulation state period in which the ink is circulated, and shuts off the first tank from the atmosphere and makes the second tank communicate with the atmosphere in a no ink-circulation state period in which the ink is not circulated; and during the printing process, the ink-circulation state and the no ink-circulation state are switched.

BRIEF DESCRIPTION OF THE DRAWINGS

FIG. 4 is a table illustrating an example in which the respective values are set so as to satisfy the condition expressed in an equation 2 in the ink-jet printer according to the first embodiment of the present invention.

FIG. 9 is a table illustrating the operations of the respective units and their transition states during the ink-circulation process in the ink-jet printer according to the first embodiment of the present invention.

DESCRIPTION OF THE PREFERRED EMBODIMENTS

Hereinafter, embodiments of the present invention are described with reference to the drawings.

First Embodiment

Figure 1:
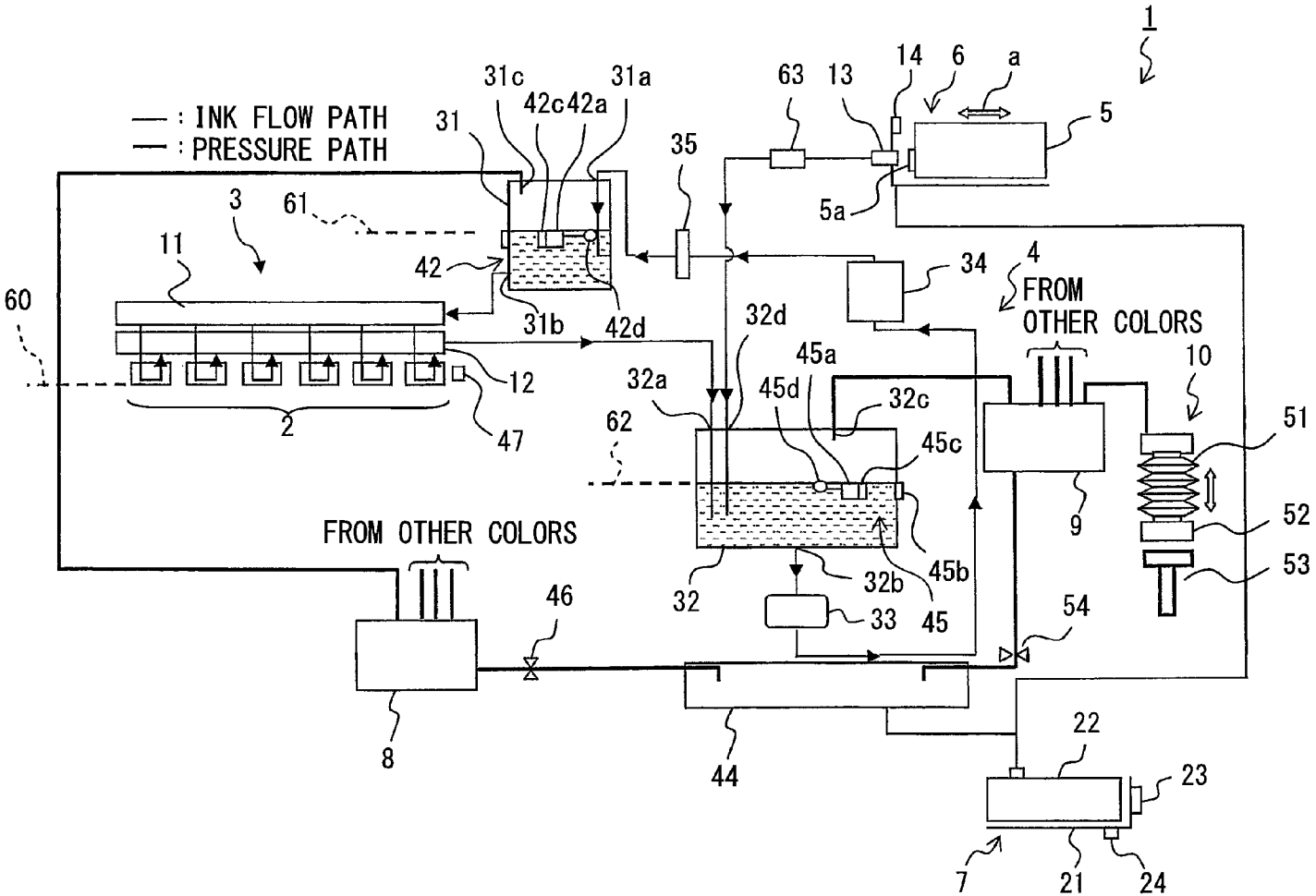
FIG. 1 is a diagram schematically illustrating the configuration of an ink path of an ink-jet printer according to a first embodiment of the present invention.

FIG. 1 is a diagram schematically illustrating a configuration of an ink path of an ink-jet printer according to the first embodiment of the present invention.

FIG. 1 does not include the illustration of structures equipped in a general ink-jet printer, such as a feeding unit feeding a recording medium, a conveying unit conveying the fed recording medium, a discharge unit discharging the recording medium on which an image is formed, a cleaning unit cleaning an ink head, and a control unit performing the control of the entire apparatus.

An ink-jet printer 1 illustrated in FIG. 1 records an image on a recording medium using ink of, for example, four kinds of colors, namely, cyan (C), magenta (M), yellow (Y) and black (K). Meanwhile, FIG. 1 illustrates the configuration of an ink path of one color as a representative.

The ink-jet printer 1 has a recording unit 3 for recording an image on the recording medium and an ink circulation path 4 for circulating ink for the recording unit 3, according to a rough classification.

The ink-jet printer 1 also has a replenishing unit 6 for replenishing the ink circulation path 4 with ink, a waste tank unit 7 storing ink that became unneeded or overflow ink, a first shared air chamber 8 shared for all colors having an atmosphere release valve 46 as a first valve for making the inside of a first tank 31 communicate with or shut off from the atmosphere, a second shared air chamber 9 shared for all colors having an atmosphere release valve 54 as a second valve for making the inside of a second tank 32 communicate with or shut off from the atmosphere, and a pressure adjustment unit 10 adjusting the pressure in the second tank of all colors through the second shared air chamber 9.

In the ink-jet printer 1, on the basis of an image signal input from outside, each ink head 2 of the recording unit 3 discharges the ink and the conveying unit (not illustrated in the drawing) conveys the recording medium, in synchronization with the ink discharge. Accordingly, an image is formed on the recording medium.

Meanwhile, in the configuration in the case of using ink in four colors in the present embodiment, independent four lines of ink circulation paths 4 are to be disposed, while the first shared air chamber 8, the second shared air chamber 9, the pressure adjustment unit 10, the waste tank unit 7, the atmosphere release valve 46 and the atmosphere release valve 54 are shared to be used for all colors.

The recording unit 3 has an ink head 2, a ink bath 11 for distributing ink to the ink head 2, and an ink bath 12 for collecting or distributing ink from/to the ink head 2. The ink bath 11 is connected to the first tank 31 and the ink head 2. The ink bath 12 is connected to the second tank 32 and the ink head 2.

While details are to be described later, a pressure in the ink head 2 is maintained at a negative pressure suitable for the printing operation for both a no ink-circulation period and an ink-circulation period. In this embodiment, the pressure in the ink head 2 is set to about −1 kPa at a gauge pressure. Accordingly, a spherically concave meniscus of ink is formed in the nozzle of the ink head 2, making it possible to perform the normal printing operation regardless of the presence/absence of the ink-circulation operation.

Figure 2:
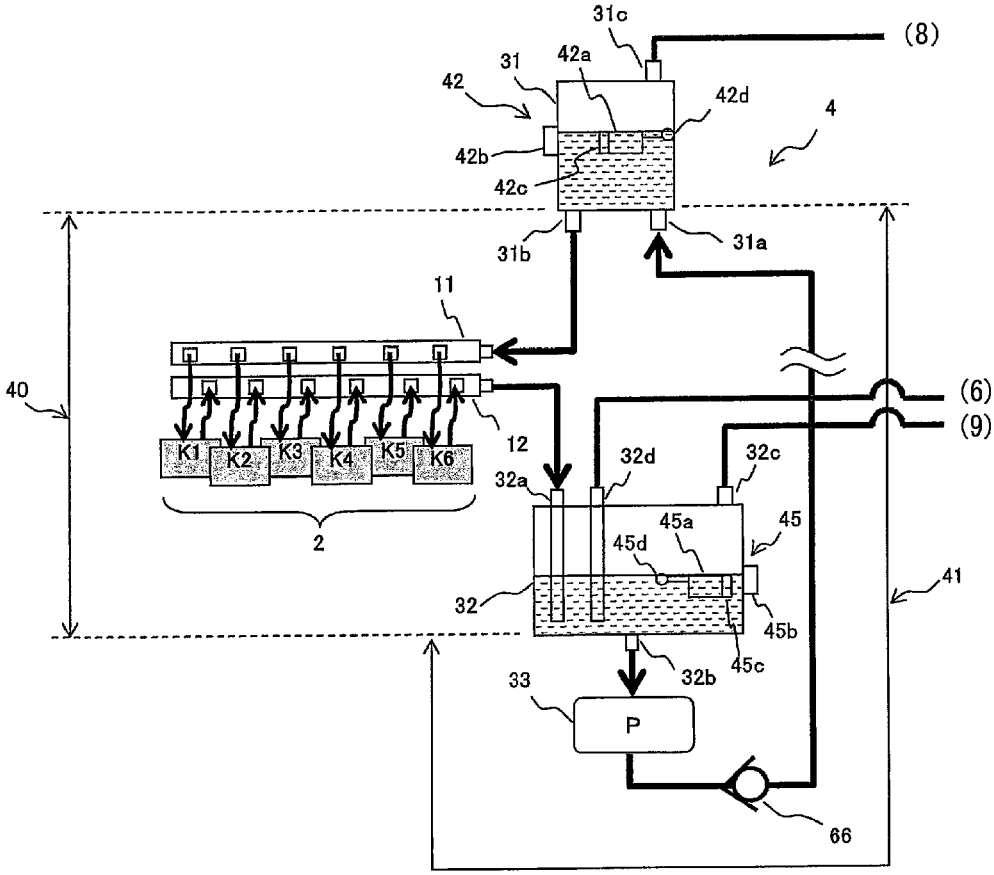
FIG. 2 is a diagram illustrating schematically while enlarging the configuration of an ink circulation path of the ink-jet printer according to the first embodiment of the present invention.

While the ink bath 11 and 12 are provided in the present embodiment, the first tank 31 and the second tank 32 may be connected to the ink head 2 directly. In addition, for the ink head 2 in the present embodiment, short heads K1-K6 that are shorter than the width of the recording medium are used as illustrated in FIG. 2, to constitute a line head by arranging the heads K1-K6 in the width direction of the recording medium in, for example, a zigzag pattern.

The replenishing unit 6 has a joint unit 13 connected to a feeding outlet 5*a* of an ink cartridge 5 filled with ink, a cartridge judging unit 14 for preventing an installment error of the ink cartridge 5 and detecting the remaining ink amount, and a supply valve 63 controlling the ink supply from the ink cartridge 5 to the second tank 32. The ink cartridge 5 can be installed and removed in the direction of the arrow a with respect to the joint unit 13.

The waste tank unit 7 has a tank tray 21, a waste tank 22 disposed on the tank tray 21, a waste ink amount detection unit 23 detecting the amount of ink stored in the waste tank 22, a tank installment detection unit 24 detecting the presence/absence of the installment of the waste tank 22, and an overflow tank 44 in a tray shape connected with the waste tank 22.

Here, the overflow tank 44 is in a state in which its top is open and communicating with the atmosphere. Also, the overflow tank 44 is disposed in a position lower than a pump 33, so that if the pump 33 breaks and ink leaks, it can catch all of the leaking ink.

In addition, the overflow tank 44 is connected to the first shared air chamber 8 through the atmosphere release valve 46. Accordingly, the first shared air chamber 8 enters the atmospheric state or the sealed state by opening and closing operations of the atmosphere release valve 46.

Furthermore, the overflow tank 44 is connected to the second shared air chamber 9 through the atmosphere release valve 54. Accordingly, the second tank shared chamber 9 enters the atmospheric state or the sealed state by opening and closing operations of the atmosphere release valve 54.

Next, the ink circulation path 4 is described. The ink circulation path 4 has the first tank 31, the second tank 32, the pump 33, a heat exchanger 34, a one-way valve 66 (see FIG. 2), and a filter 35. In these constituent parts, as the positional relationship of a nozzle face 60 at which the nozzles of the ink head 2 are formed, an ink liquid level 61 of the first tank 31, and an ink liquid level 62 of the second tank 32, the order from the low to high positions in the vertical direction (gravitational direction) is: the ink liquid level 62, the nozzle face 60, the ink liquid level 61.

In the ink circulation path 4, respective parts are connected by tubes so that, in the ink-circulation period, ink flows from the first tank 31 to the ink bath 11, the ink head 2, the ink bath 12, the second tank 32, the pump 33, the one-way valve 66, the heat exchanger 34 and the filter 35, in this order, and returns to the first tank 31.

Meanwhile, the first shared air chamber 8 is connected to the first tank 31, and the second shared air chamber 9 is connected to the second tank 32.

Here, the configuration of the ink circulation path 4 is described in greater detail.

FIG. 2 is a diagram illustrating the configuration of the ink circulation path 4 schematically and more enlarged than in FIG. 1. The thick arrow in FIG. 2 illustrates the direction in which ink circulates in the ink circulation path 4 in the ink circulation period. In addition, in order to make the illustration concise, while the piping configuration of the first tank 31 differs slightly between FIG. 1 and FIG. 2, but the same number is assigned in FIG. 1 and FIG. 2 for the part having the same function in FIG. 1 and in FIG. 2.

Hereinafter, the details of the ink circulation path 4 are described using FIG. 2 (see also FIG. 1).

The ink circulation path 4 of the present embodiment can be divided roughly into two: a first path 40 and a second path 41. The first path 40 is a path in which ink flows from the first tank 31 to the second tank 32 via the ink head 2.

First, individual structures of the first path 40 are described in detail.

The first tank 31 is equipped with an ink inlet port 31*a*, an ink outlet port 31*b*, and an atmosphere port 31*c*.

In addition, in the first tank 31, a liquid level detection unit 42 is provided for maintaining the ink liquid level at a predetermined height. The liquid level detection unit 42 consists of a float member 42*a* supported by a supporting shaft 42*d* so that the float member 42*a* can turn in the first tank 31 in accordance with the height of the liquid level, and a liquid level position sensor 42*b* consisting of, for example, a magnetic sensor.

The liquid position sensor 42*b* detects the position of the float member 42*a*, that is, the ink liquid level 61 of the first tank 31, by detecting the magnetic force of a magnet 42*c* attached to the float member 42*a*.

The ink inlet port 31*a* is connected to the filter 35 (see FIG. 1) on the second path 41 described later, through a tube. After passing the filter 35, ink flows into the first tank 31.

The ink outlet port 31*b* is connected to the ink bath 11 through a tube. Ink in the first tank 31 flows into the ink bath 11.

Ink that flowed into the ink bath 11 is distributed into each ink head 2 approximately evenly. Then, the ink head 2 discharges ink on a conveyed recording medium from nozzles formed on the nozzle face 60, to perform image recording.

Here, the amount of ink that flows into the ink head 2 is set to be larger than the amount of ink discharged from the nozzles. Therefore, ink that was not discharged from the ink head 2 flows into the ink bath 12. Then, ink in the ink bath 12 flows into the second tank 32 via a tube.

The atmosphere port 31*c* is connected to the first shared air chamber 8. The first air shared chamber 8 is also connected to the atmosphere port in the first tank 31 of other colors (see FIG. 1).

The second tank 32 is equipped with an ink inlet port 32*a* through which ink flows in from the ink bath 12 via a tube, an outlet port 32*b* sending out ink to the pump 33, an atmosphere port 32*c* connected to the second shared air chamber 9, and a supply port 32*d* through which ink supplied from the ink cartridge 5 flows in.

In addition, in the second tank 32, a liquid level detection unit 45 similar to that of the first tank 31 is disposed for maintaining the ink liquid level at a predetermined height.

The liquid level detection unit 45 consists of a float member 45*a* supported by a supporting shaft 45*d* so that the float member 45*a* can turn in the second tank 32 in accordance with the height of the liquid level, and a liquid level position sensor 45*b* consisting of, for example, a magnetic sensor.

The liquid position sensor 45*b* detects the position of the float member 45*a*, that is, the ink liquid level 62 in the first tank 32, by detecting the magnetic force of a magnet 45*c* attached to the float member 45*a*.

Meanwhile, the opening and closing operations of the supply valve 63 are controlled on the basis of the detection results of the liquid level detection unit 42 and the liquid level detection unit 45. That is, ink is supplied from the ink cartridge 5 to the second tank 32 on the basis of the detection results of the liquid level detection unit 42 and the liquid level detection unit 45.

Next, the second path 41 is described in detail. The second path 41 is a path for sending ink in the second tank 32 back to the first tank 31. The second path 41 is equipped with the pump 33, the one-way valve 66, the heat exchanger 34 (see FIG. 1), and the filter 35.

Individual structures of the second path 41 are described in detail.

For the pump 33, an electromagnetic piston pump can be used, for example. The driving and stopping of the pump 33 are performed in accordance with the detection results of the liquid level detection unit 42 and the liquid level detection unit 45, to maintain the height of the ink liquid level 61 and the ink liquid level 62 within a desired range.

In this embodiment, the liquid-delivery capacity of the pump 33 is set so that the pump 33 can deliver more ink to the first tank 31 than the amount of ink flowing into the second tank 32. This is for preventing the overflow from the second tank 32.

Meanwhile, while the electromagnetic piston pump is used for the pump 33 in this embodiment, this is not a limitation. As described above, as long as the pump can deliver more ink than to the first tank 31 than the amount of ink flowing into the second tank 32, a diaphragm pump, a gear pump, a tube pump, a rotary pump, or a spiral pump may be used as the pump 33.

The ink discharging side (the first tank 31 side) of the pump 33 is connected to the one-way valve 66. The one-way valve 66 prevents the backward flow of ink (backward flow from the first tank 31 to the second tank 32) due to the difference in height between the ink liquid level 61 of the first tank 31 and the ink liquid level 62 of the second tank 32. In other words, the one-way valve 66 prevents the backward flow of ink from the second path 41 when the pump 33 is stopped.

The heat exchanger 34 (see FIG. 1) warms up or cools down ink flowing in the ink circulation path 4. In other words, the heat exchange 34 controls the temperature of ink flowing in the ink circulation path 4 to a desired temperature at which image recording can be performed. Meanwhile, in the ink head 2 or in an ink flow path in the vicinity of the ink head 2, a temperature sensor 47 (see FIG. 1) is disposed for controlling the ink heat exchanger 34.

The filter 35 eliminates foreign matters contained in ink. Accordingly, the nozzle of the ink head 2 does not get a clog and the like.

Next, the pressure adjustment unit 10 is described.

The pressure adjustment unit 10 (hereinafter, see FIG. 1) has a bellows 51, a weight 52 and a bellows lifting and lowering mechanism 53.

The bellows 51 is connected to the second shared air chamber 9 by a tube. Meanwhile, the weight 52 is attached to the bellows 51. The weight 52 is lifted and lowered by the bellows lifting and lowering mechanism 53. When the bellows lifting and lowering mechanism 53 ascends, the bellows 51 shrinks, and when the bellows lifting and lowering mechanism 53 descends, the bellows 51 expands with the weight 52. The position of the bellows lifting and lowering mechanism 53 in the state in which the bellows 51 is shrunk is assumed as a standby position. The position of the bellows lifting and lowering mechanism 53 in the state in which the bellows 51 is expanded is assumed as a negative-pressure generating position.

When the atmosphere release valve 54 is closed here, an air part in the second tank 32, and the inside of the second tank shared chamber unit 9 and the bellows 51 become a connected space that is closed off from the outside. When the bellows 51 is expanded and shrunk in this state, the volume of the closed space increase and decreases. Accordingly, the pressure inside the second tanks 32 of all colors can be changed simultaneously.

In other words, when the bellows lifting and lowering mechanism 53 is moved from the standby position to the negative-pressure generating position (the state illustrated in FIG. 1) in the state in which the atmosphere release valve 54 is closed, the bellows 51 is pulled downward by the weight of the weight 52, and the volume of the closed space mentioned above increases. Accordingly, a balanced amount of negative pressure with the gravity placed on the weight 52 is applied inside the second shared air chamber 9.

Since the second shared air chamber 9 is connected with the second tank 32, the same negative pressure is applied to the second tank 32. Since the second tank 32 is further connected with the ink head 2 through a tube, the same negative pressure is applied to the ink head 2. The negative pressure is set at a pressure suitable for printing in the ink-circulation period (for example, a nozzle pressure of about −1 kPa in the ink-circulation period). Accordingly, a meniscus is formed in the nozzle of the ink head 2. Meanwhile, the negative pressure generated by the pressure adjustment unit 10 also affects the amount of ink flowing into the second tank from the first tank 31 via the ink head 2.

Next, the configuration in the present embodiment in which the operations can be switched between the no ink-circulation period and the ink-circulation period is described.

Figure 3:
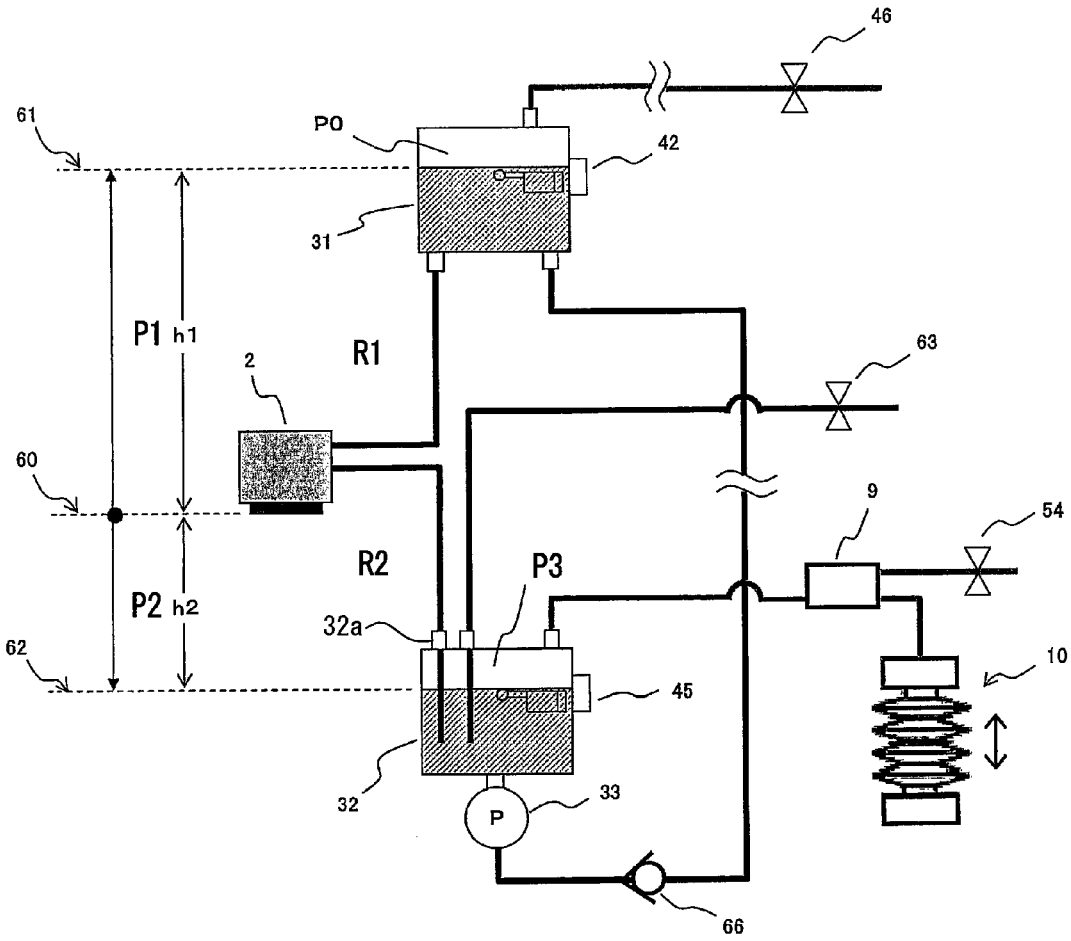
FIG. 3 is a diagram describing the configuration in the ink-jet printer according to the first embodiment of the present invention in which operations can be switched between a no ink-circulation period and an ink-circulation period.

FIG. 3 is a diagram describing the configuration in which the operations can be switched between the no ink-circulation period and the ink-circulation period. FIG. 3 illustrates, in the configurations described in FIG. 1 and FIG. 2, only the configuration required for the explanation.

As illustrated in FIG. 3, as the positional relationship of the ink liquid level 61 of the first tank 31 and the nozzle face 60 of the ink head 2, the ink liquid level 61 is positioned higher than the nozzle face 60 in the vertical direction (gravitational direction) by "h1".

Meanwhile, as the positional relationship between the ink liquid level 62 of the second tank 32 and the nozzle face 60 of the ink head 2, the nozzle face 60 is positioned higher than the ink liquid level 62 in the vertical direction (gravitational direction) by "h2".

By positioning the first tank 31, ink head 2 and the second tank 32 as described above, a water head differential pressure due to the difference in height is applied to the ink head 2. The value of water head differential pressure is obtained by multiplying an ink density, gravitational acceleration and difference in height by each other.

Therefore, a water head differential pressure being a positive pressure (positive water head differential pressure) is applied to the ink head 2 by the difference in height between the ink liquid level 61 and the nozzle face 60. The positive water head differential pressure is assumed as "P1".

In the same manner, a water head differential pressure being a negative pressure (negative water head differential pressure) is applied to the ink head 2 by the difference in height between the ink liquid level 62 and the nozzle face 60. This negative water head differential pressure is assumed as "P2".

In addition, the pressure applied inside the first tank 31 is assumed as "P0", and the pressure applied inside the second tank 32 is assumed as "P3".

Furthermore, the resistance of the flow path from the first tank 31 to an ink room (not illustrated in the drawing) formed inside the ink head 2 in the vicinity of the nozzle is assumed as "R1", and the resistance of the flow path from the ink room (not illustrated in the drawing) formed inside the ink head 2 in the vicinity of the nozzle to the second tank 32 is assumed as "R2".

In the state during the no ink-circulation period, the pump 33 is stopped, the atmosphere release valve 46 is closed, and the atmosphere release valve 54 is opened.

First, the pressure P3 applied to the second tank 32 is explained.

The inside of the pressure adjustment unit 10 is communicating with the atmosphere through the second shared air chamber 9, since the atmosphere release valve 54 is open. Therefore, the inside of the second tank 32 communicates with the atmosphere, and its internal pressure P3 is the atmospheric pressure (a gauge pressure of zero).

Next, the pressure P0 applied to the first tank 31 is explained.

To the inside of the first tank 31, since the inside of the second tank 32 is communicating with the atmosphere and the inside of the first tank 31 is shut off from the atmosphere, a water head differential pressure generated by the difference in height "h1+h2" between the ink liquid level 62 of the second tank 32 and the ink liquid level 61 of the first tank 31 is applied.

That is, the pressure P0 applied to the first tank 31 is maintained at a certain negative pressure. Thus, since the negative pressure is applied inside the first tank 31, no ink falls constantly from the first tank 31 to the second tank 32.

Therefore, the pressure loss generated by the flow path resistance R1 can be ignored.

Next, the pressure applied to the nozzle of the ink head 2 is explained.

The pressure applied to the nozzle of the ink head 2 is, since the inside of the second tank 32 is communicating with the atmosphere and the inside of the first tank 31 is shut off from the atmosphere, only the negative water head differential pressure P2 generated by the difference in height h2 between the nozzle face 60 and the ink liquid level 62.

Here, the flow of ink when printing is performed during the no ink-circulation period is distributed to the ink head 2 from the inlet port 32*a* of the second tank 32 via the ink bath 12 (see FIG. 1 or FIG. 2). In other words, the flow is in the direction opposite to the direction during ink-circulation period.

The ink flows in this way because the ink in the second tank 32 is sucked up by the amount of ink discharged from the ink head 2.

Meanwhile, the path from the ink head 2 to the second tank 32 has the flow path resistance R2. However, since the amount of ink flows in the path from the second tank 32 to the ink head 2 is the discharged small amount, the pressure loss generated by the flow path resistance R2 can be ignored.

Thus, during the no ink-circulation period, since the influence of the pressure loss by the flow path resistance R2 can be ignored, the pressure applied to the nozzle of the ink head 2 is determined only by the negative water head differential pressure P2.

By the negative water differential pressure P2, that is, the difference in height between the nozzle face 60 and the ink liquid level 62, an optimal meniscus is formed in the nozzle of the ink head 2. Then, the ink head 2 enters the state in which printing can be performed.

Meanwhile, in this embodiment, the negative water differential pressure P2 is set to −1 kPa with the difference in height h2. However, the value of the negative water differential pressure P2 is not limited to this, and the optimal negative water differential pressure P2 may be set. In other words, the difference in height between the ink head 2 and the ink liquid level 62 may be set.

For supplying ink, the supply valve 63 is opened when the liquid level sensor 45 determines that the ink amount is insufficient. Accordingly, ink in the ink cartridge 5 is supplied into the second tank 32. When the liquid level sensor 45 determines that the ink has been supplied sufficiently, the supply valve 63 is closed.

Meanwhile, in the state during the ink-circulation period, the pump 33 is activated, the atmosphere release valve 46 is opened, and the atmosphere release valve 54 is closed.

First, the pressure P0 applied to the first tank 31 is explained.

The inside of the tank 31 is communicating with the atmosphere since the atmosphere release valve 46 is open. Therefore, the pressure P0 applied to the inside of the first tank 31 is the atmospheric pressure (a gauge pressure of zero).

Next, the pressure P3 applied to the second tank 32 is explained.

To the inside of the second tank 32, since the inside of the second tank 32 is shut off from the atmosphere, a negative pressure generated by the pressure adjustment unit 10 is applied. That is, the pressure P3 applied inside the second tank 32 is a negative pressure. Here, the pressure P3 is adjusted so as to be always maintained at a constant negative pressure by the pressure adjustment 10.

Next, the pressure applied to the nozzle of the ink head 2 is explained.

The pressure applied to the nozzle of the ink head 2 is the positive water head differential pressure P1 generated by the difference in height h1 between the nozzle face 60 and the ink liquid level 61, the negative water differential pressure P2 generated by the difference in height h2 between the nozzle 60 and the ink liquid level 62, and the pressure P3 inside the second tank 32.

Meanwhile, during the ink-circulation, ink flows constantly in the first tank 31, the ink head 2 and the second tank 32, in this order. Therefore, the flow path resistance R1 from the first tank 31 to the ink head 2 and the flow path resistance R2 from the ink head 2 to the second tank 32 need to be taken into consideration.

Therefore, in the ink-circulation state, the pressure applied to the nozzle of the ink head 2 is as follows.

$$(P0+P1)-(1/(1+R2/R1))*(P0+P1-P2-P3)$$

The inside of the first tank 31 is communicating with the atmosphere. Therefore, $$P1-(1/(1+R2/R1))*(P1-P2-P3).$$

Here, in this embodiment, in order to make it possible to perform printing both in the no ink-circulation period and in the ink-circulation period, the pressure applied to the nozzle during the no ink-circulation period and the pressure applied to the nozzle during the ink-circulation period are set to be equal. Therefore, the ink path is configured to realize the relationship in the following equation.

$$P2=P1-(1/(1+R2/R1))*(P1-P2-P3) \qquad \text{equation 1}$$

That is, the equation 1 can be modified as follows.

$$(P1-P2)/(P1-P2-P3)=R1/(R1+R2)$$

$$1/(1-(P3/(P1-P2))=1/(1+R2/R1)$$

Therefore, the relationship that the ink path is required to realize is $$-(P3/(P1-P2))=R2/R1 \qquad \text{equation 2.}$$

In this embodiment, the pressure applied to the nozzle in the no ink-circulation period is determined only by P2, and the P2 is set to −1.0 kPa.

Therefore, in order to set the pressure applied to the nozzle in the ink-circulation period to −1.0 kPa as well, P1, P3, R1, R2 are set to satisfy the relationship expressed in the equation 2. Meanwhile, in order to secure the ink-circulation amount, the setting is made to realize P1>0, P3<0.

FIG. 4 is a table illustrating an example in which the respective values are set so as to satisfy the condition expressed in the equation 2. EXAMPLE 1 in the table illustrates an example of a case in which R2 is larger than R1, and R2/R1=0.5.

In such a case, the above equation 2 can be satisfied by, for example, setting P1 to 2.0 kPa and P3 to −1.5 kPa.

At this time, the pressure applied to the nozzle in the ink-circulation period is −1.0 kPa according to the equation "P1−(1/(1+R2/R1))*(P1P2−P3)", which is equivalent to the pressure applied to the nozzle in the no ink-circulation period.

EXAMPLE 2 in the table illustrates an example of a case in which R2=R1. The equation 2 can be modified as P2=P1+P3 with R2=R1.

In such a case, with R2/R1=1.0, the above equation can be satisfied by, for example, setting P1 to 1.7 kPa and P3 to −2.7 kPa.

At this time, the pressure applied to the nozzle in the no ink-circulation period and the pressure applied to the nozzle in the ink-circulation period are equally −1.0 kPa.

EXAMPLE 3 in the table illustrates an example of a case in which P1=−P2. The equation 2 can be modified as R2/R1=−P3/(2*P1)) with P1=−P2.

In such a case, since P1=−P2=1.0 kPa, the above equation can be satisfied by, for example, setting P3 to −4.0 kPa and R2/R1 to 2.0.

At this time, the pressure applied to the nozzle in the no ink-circulation period and the pressure applied to the nozzle in the ink-circulation period are equally −1.0 kPa.

EXAMPLE 4 in the table illustrates an example of a case in which P1=−P2 and R2=R1. The equation 2 can be modified as 2*P1=−P3 with R2=R1.

In such a case, since P1=−P2=1.0 kPa, R2/R1=1.0, the above equation can be satisfied by, for example, setting P3 to −2.0 kPa.

At this time, the pressure applied to the nozzle in the no ink-circulation period and the pressure applied to the nozzle in the ink-circulation period are equally −1.0 kPa.

EXAMPLE 5 in the table illustrates an example of a case in which P1=−P2=−P3. The equation 2 becomes R2/R1=P1/(2*P1) with P1=−P2=−P3.

In such a case, since P1=−P2=−P3=1.0 kPa, R2/R1=0.5.

At this time, the pressure applied to the nozzle in the no ink-circulation period and the pressure applied to the nozzle in the ink-circulation period are equally −1.0 kPa.

Meanwhile, while the setting is performed to set P2 to −1 kPa in this embodiment, without being limited to this value, a pressure with which the ink head 2 becomes optimal for printing may be set.

In addition, while in the above description, the flow path resistances are assumed as R1 and R2, the flow path resistance varies with the change of the viscosity of the liquid flowing in the ink path due to the temperature.

However, in the equation 2 is set so that the ratio of flow path resistances "R2/R1" affects the set values but is not affected by the viscosity.

Next, switching operations from the standby state of the apparatus to the ink-circulation state and the no ink-circulation state is explained.

Figure 5:
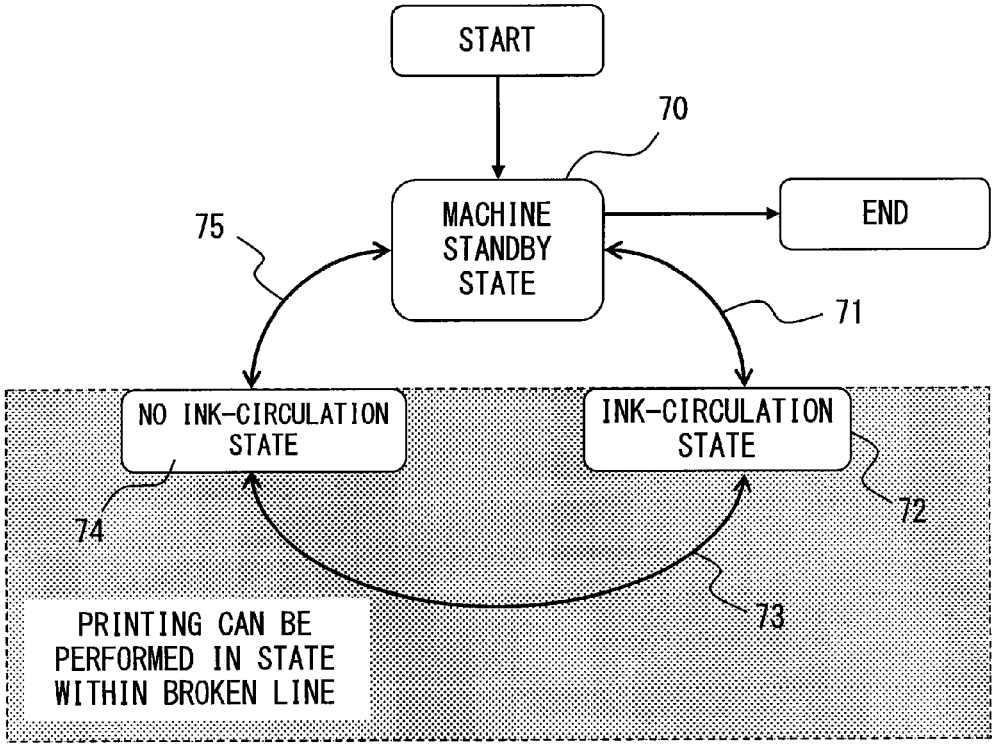
FIG. 5 illustrates the state transition in the ink-jet printer according to the first embodiment of the present invention.

FIG. 5 illustrates the state transition in the present embodiment. In FIG. 5, when the power of the ink-jet printer 1 (hereinafter, referred to as a machine) is turned on to set it to the operating state, a state-switching operation illustrated in FIG. 5 is started.

First, from a machine standby state 70, a transition process 75 to the no ink-circulation state 74 or a transition process 71 to the ink-circulation state 72 is selected under given conditions.

Here, given conditions include occasions such as when air bubbles in the ink circulation path need to be removed, or when the machine is activated (when the power is turned on), or immediately before printing starts, or when a predetermined period of time has passed, or when the temperature of ink deviates from a desired temperature range, and so on.

When these conditions are satisfied, transition to the ink-circulation state 72 is performed, and when these conditions are not satisfied, transition to the no ink-circulation state 74 is performed.

The transition process 75 and the transition process 71 can be bidirectional, and transition from the no ink-circulation state 74 to the standby state 70, and transition from the ink-circulation state 72 to the standby state 70 can also be performed.

A transition process 73 is also bidirectional, and transition from the ink-circulation state 72 to the no ink-circulation state 74, and transition from the no ink-circulation state 74 to the ink-circulation state 72 can be performed.

In the transition process 73, the switching between the no ink-circulation state 74 and the ink-circulation state 72 is performed in accordance with conditions such as when air bubbles in the ink circulation path need to be removed, or when printing has been done for a predetermined number of sheets, or when a predetermined period of time has passed, or when the temperature of ink deviates from a desired temperature range, and so on.

The part enclosed by the broken line in FIG. 5 indicates the range in which printing can be performed; printing can be performed in the state of the no ink-circulation state 74, ink-circulation state 72, and the transition process 73. In addition, the operation termination of the machine (termination of the transition process) is performed from the machine standby state 70.

Figure 6:
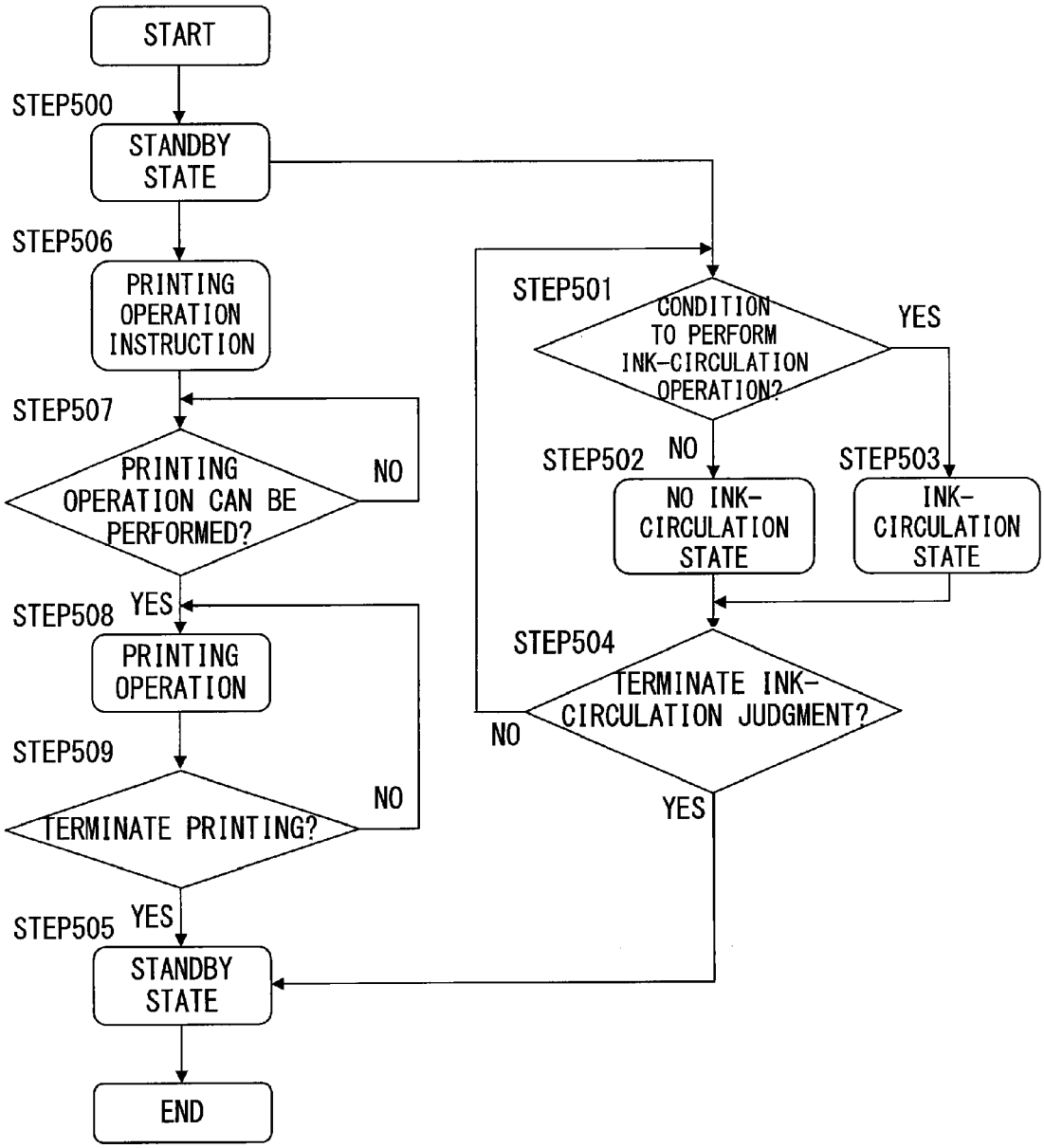
FIG. 6 is a flowchart illustrating the processing operation for performing the switching to each state in the state transition in the ink-jet printer according to the first embodiment of the present invention.

FIG. 6 is a flowchart illustrating the processing operation for performing the switching to each state illustrated in the state transition in FIG. 5.

The process for performing the switching to each state is conducted in parallel with the printing processing operation or independently from the printing processing operation. In addition, the process is performed by the control unit which is not illustrated.

The printing processing operation in FIG. 6 is explained first. When the power of the machine is turned on to set it to the operable state, the process illustrated in FIG. 6 is started by the control unit.

In STEP500, the control unit is in the standby state waiting for a printing operation instruction or an instruction as to whether or not to perform the ink-circulation operation, from a user. At this time, the ink circulation path 4 is in the no ink-circulation state in which ink is not circulating.

When the user issues a printing operation instruction (STEP506), the control unit determines, in STEP 507, whether or not conditions under which printing can be performed are satisfied. When the conditions are not satisfied, it waits until the conditions are satisfied (NO in STEP507).

Then, when it is determined that the conditions are satisfied (YES in STEP507), the printing processing operation is performed in STEP508.

During the printing processing operation, determination of whether or not the printing has been done for a predetermined number of sheets in accordance with the printing operation instruction and the printing is to be terminated is performed (STEP509). Then, when the printing has not been done for a predetermined number of sheets (NO in STEP509), the processes of STEP508 and STEP509 are repeated to carry on the printing processing operation.

When the printing has been done for a predetermined number of sheets (YES in STEP509), the process proceeds to STEP505, returning to the standby state of the machine. Then, a machine ending process is performed (see FIG. 5).

Meanwhile, the condition judgment process illustrated in STEP501-504 and the state transition process in accordance with the condition judgment process diverges from the standby state in STEP500 and is performed in parallel with the printing state in STEP506-509.

That is, first, in STEP501, the control unit determines whether or not the state of the machine satisfies the given conditions for performing the ink-circulation operation described above. Then, when it does not satisfy the conditions (NO in STEP501), the process proceeds to STEP502. Then, the ink circulation path 4 enters the no ink-circulation state.

On the other hand, when the state of the machine satisfies the given conditions for performing the ink-circulation operation (YES in STEP501), the process proceeds to STEP503. Then, the ink circulation path 4 enters the ink-circulation state.

Either in the no ink-circulation state in STEP502 or in the ink-circulation state in STEP503, determination of whether or not the "determination for the ink-circulation operation" is to be terminated is always performed in STEP504. In other words, the determination process in STEP504 is constantly performed during the printing processing operation.

Then, when the "determination for the ink-circulation operation" is to be continued (NO in STEP504), the control unit returns to STEP501, and the process is repeated.

Meanwhile, when the termination of the "determination for the circulation operation" is determined in STEP504 (YES in STEP504), the process returns to the standby state in STEP505 described above, and the machine ending process is performed.

While the processes of STEP501-STEP504 are always performed when the printing operation in STEP506-STEP509 is performed, but even when the printing operation is not performed, the processes can be performed independently for removing air bubbles in the ink circulation path or for adjusting the ink temperature.

Figure 7:
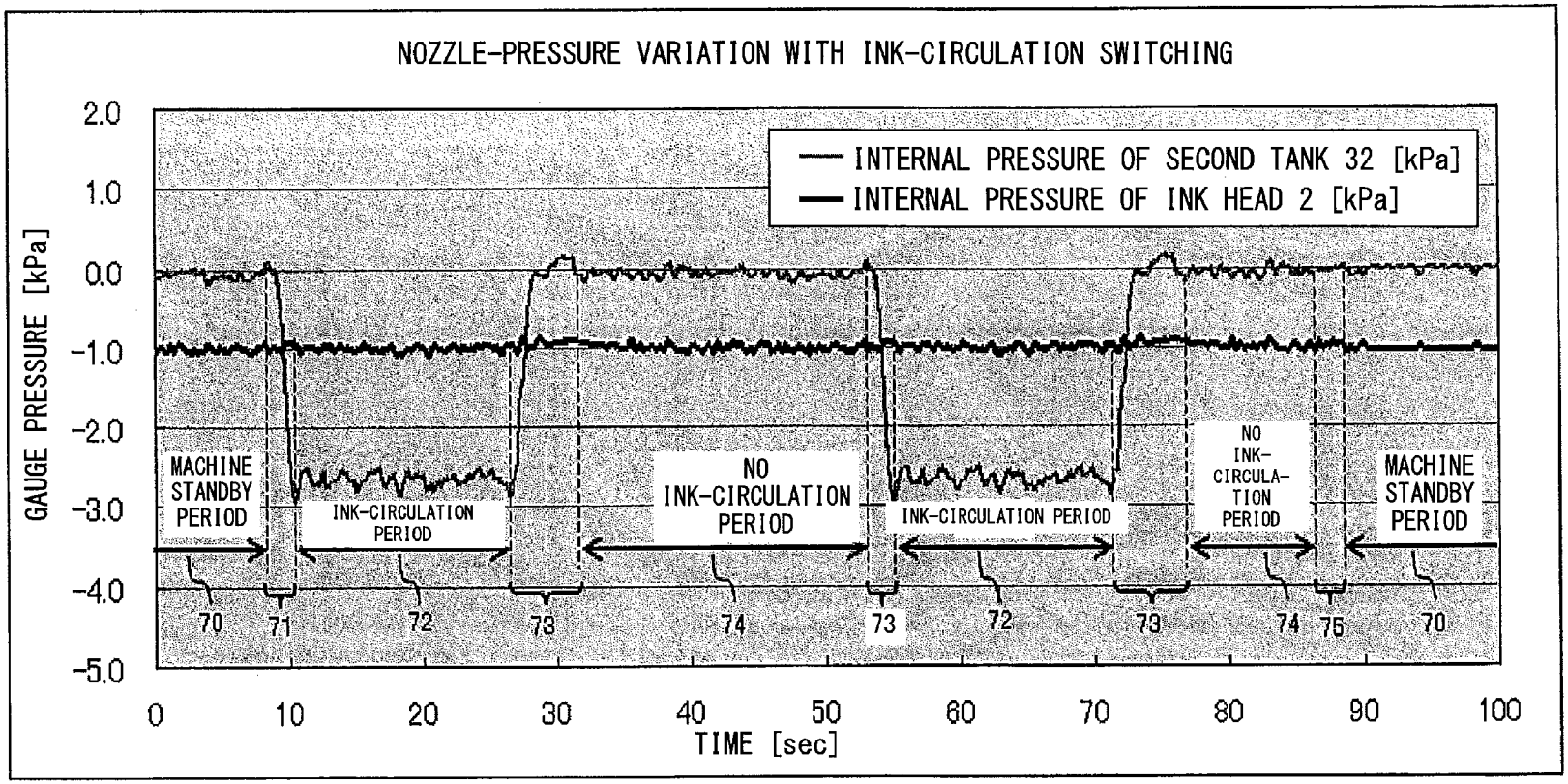
FIG. 7 is a graph illustrating the result of the measurement of the variation of the pressure applied to the nozzle of the ink head and the internal pressure of the second tank when the switching between the no ink-circulation and the ink-circulation operations is performed during the printing operation in the ink-jet printer according to the first embodiment of the present invention.

FIG. 7 is a graph illustrating the result of the measurement of the variation of the pressure applied to the nozzle of the ink head 2 and the internal pressure of the second tank 32 when the switching between the no ink-circulation and ink-circulation operations is performed during the printing operation in the present example described in FIG. 5 and FIG. 6.

The horizontal axis of the graph of FIG. 7 represents the time (sec), and the vertical axis represents the pressure value (kPa). In addition, the ranges 70-75 shown at the bottom of the graph along the time axis represent the numbers of the respective states described in FIG. 5.

That is, the range 70 in FIG. 7 shows the pressure variation during the standby state 70 in FIG. 5. The range 71 in FIG. 7 shows the pressure valuation during the transition 71 between the standby state 70 and the ink-circulation state 72 in FIG. 5. The range 72 in FIG. 7 shows the pressure variation during the ink-circulation state 72 in FIG. 5. The range 73 in FIG. 7 shows the pressure variation during the transition 73 between the no ink-circulation state 74 and the ink-circulation state 72 in FIG. 5. The range 74 in FIG. 7 shows the pressure variation during the no ink-circulation state 74 in FIG. 5. The range 75 in FIG. 7 shows the pressure variation during the transition 71 between the standby state 70 and the no ink-circulation state 74 in FIG. 5.

Thus, according to the waveform illustrated in FIG. 7, the pressure applied to the nozzle of the ink head 2 is stable in all the ranges.

In other words, for the ink head in the present embodiment, the pressure of −0.5 to −1.5 kPa applied to the nozzle satisfies the printing quality, and the pressure shown in the graph is constantly maintained in the range of −0.5 to −1.5 kPa.

Therefore, in this example, the pressure that can satisfy the printing quality can be maintained even during the switching of the ink-circulation operations from the standby period to the ink-circulation period, from the ink-circulation period to the no ink-circulation period, from the no ink-circulation period to the ink-circulation period, and from the no ink-circulation period to the standby period.

Thus, in the ink-jet printer 1, the switching between the no ink-circulation and ink-circulation operations can be performed even during the printing operation. This makes it possible to remove air bubbles in the ink circulation path 4 by the ink-circulation operation, without stopping the printing operation.

Next, further, details of the switching operation from the no ink-circulation state to the ink-circulation state are described.

Figure 8:
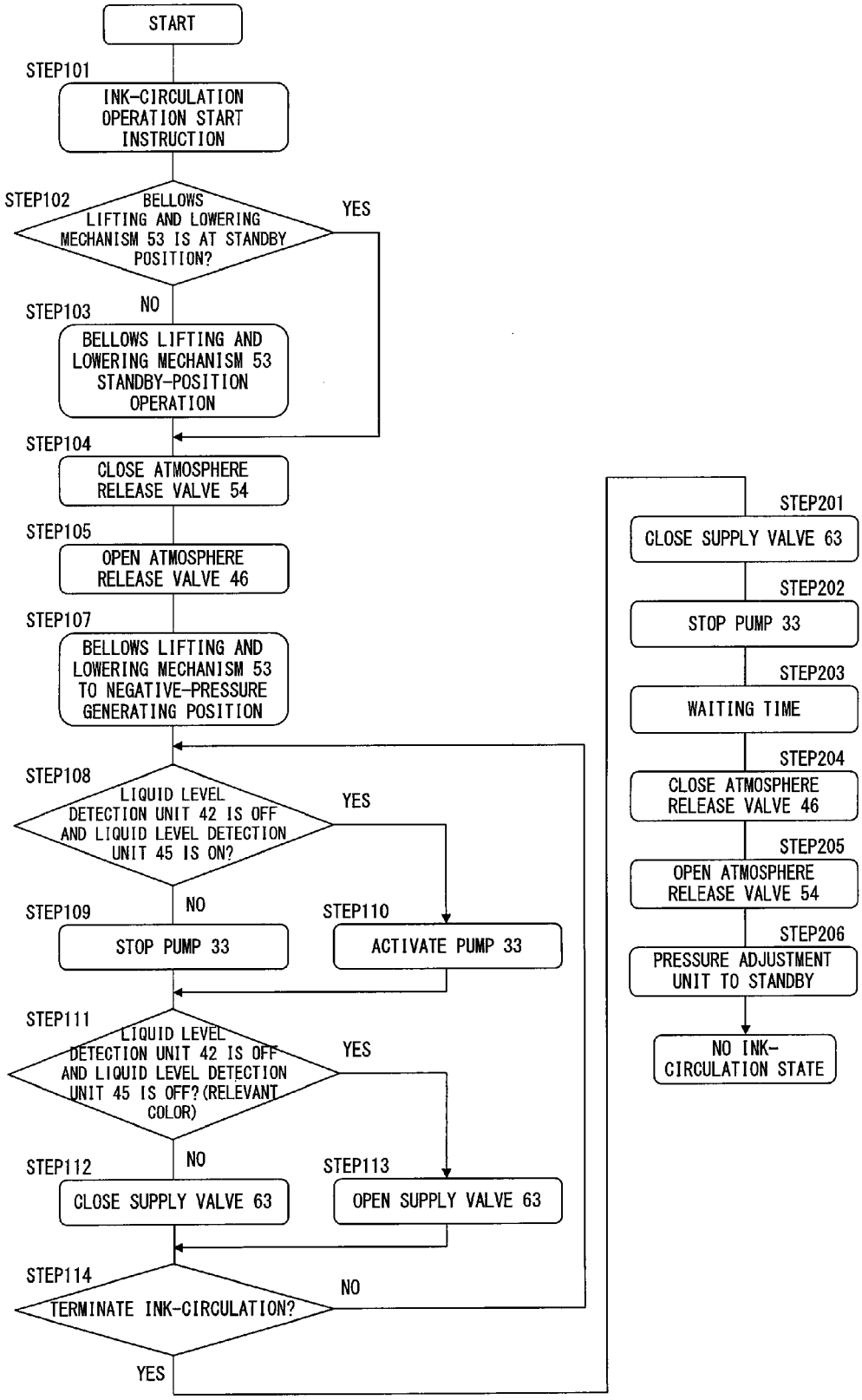
FIG. 8 is a flowchart describing the switching processing operation from the no ink-circulation to the ink-circulation and from the ink-circulation to the no ink-circulation in the ink-jet printer according to the first embodiment of the present invention.

FIG. 8 is a flowchart describing the switching processing operation from the no ink-circulation to the ink-circulation and from the ink-circulation to the no ink-circulation.

The process is also performed by the control unit which is not illustrated. Meanwhile, the no ink-circulation state (same as the standby state) of the ink circulation path 4 is as described below.

The atmosphere release valve 46 is closed (shut off from the atmosphere). The atmosphere release valve 54 is open (communicating with the atmosphere). The pump 33 is stopped. The supply valve 63 is closed. The pressure adjustment unit 10 is stopped (in the state in which the negative pressure generation is not performed).

The ink-circulation operation is performed from this state (the no ink-circulation state or the standby state). As described in FIG. 8, first, the instruction for starting the ink-circulation operation is issued by the control unit (STEP101).

In this process, the control unit issues an instruction (order) for the ink-circulation when air bubbles in the ink circulation path need to be removed, or when the machine is activated (the power is turned on), or immediately before printing starts, or when a predetermined period of time has passed, or when the temperature of ink deviates from a desired temperature range, and so on.

In STEP102, the control unit checks whether or not the bellows lifting and lowering mechanism 53 is at the standby position with the start instruction for the ink-circulation operation.

This check process is a process in which the control unit checks whether or not the pressure adjustment unit 10 required for generating a negative pressure in the second tank 32 is at the standby position.

That is, in the process, determination is made as to whether or not the bellows lifting and lowering mechanism 53 is in the state in which the bellows 51 is shrunk by the weight 52 to suppress the stretch of the bellows 51.

Meanwhile, the position of the bellows lifting and lowering mechanism 53 is detected by a position sensor which is not illustrated in the drawing. Then, when it is detected that the bellows lifting and lowering mechanism 53 is not at the standby position (NO in STEP102), the process proceeds to STEP103. In STEP103, the control unit moves the bellows lifting and lowering mechanism 53 to the standby position. This completes preparations for generating a negative pressure inside the second tank 32. After this, the control unit performs the process of STEP104.

On the other hand, when it is detected that the bellows lifting and lowering mechanism 53 is at the standby position (YES in STEP102), the process proceeds to STEP104.

In STEP104, the control unit shuts off the inside of the second tank 32 from the atmosphere through the second shared air chamber 9 by closing the atmosphere release valve 54.

Next, in STEP105, the control unit makes the inside of the first tank 31 communicate with the atmosphere through the first air chamber 8 by opening the atmosphere release valve 46.

Further, in STEP107, the control unit moves the bellows lifting and lowering mechanism 53 from the standby position to the negative-pressure generating position, to generate a negative pressure inside the second tank 32.

The negative-pressure generating position of the bellows lifting and lowering mechanism 53 is a position lower than the standby position in the gravitational direction at which even if the bellows 51 expands with the weight of the weight 52, the weight 52 is not supported by the bellows lifting and lowering mechanism 53. Accordingly, the bellows 51 is pulled downward by the weight of the weight 52, and a pressure lower than that of the atmosphere in the amount balanced with the gravity placed on the weight 52 is generated in the bellows 51, the second shared air chamber 9, and the second tank 32.

The operations of the processes of STEP104-STEP107 described above are performed approximately at the same time or successively within a short period of time. This is for suppressing the amount of variation of the internal pressures of the first tank 31 and the second tank 32 that occurs with the transition of ink in the ink circulation path 4 from a static state to a dynamic state That is, the variation of the internal pressures of the first tank 31 and the second tank 32 also affects the internal pressure of the ink head 2, which may break the meniscus formed in the nozzle of the ink head 2 or may cause printing failure (uneven printing and discharge failure) during printing.

Thus, by performing the operations of the processes of STEP104-STEP107 approximately at the same time or successively within a short period of time, the variation of the pressure applied to the nozzle can be suppressed to very small amounts as illustrated in the range 71 and the range 73 in FIG. 7. Specifically, the pressure applied to the ink head 2 can be maintained constantly at a negative pressure of approximately −1 kPa which is suitable for printing.

When the three STEPs (STEP104, STEP105, STEP107) described above are performed, the first tank 31 communicates with the atmosphere, and a pressure lower than that of the atmosphere (negative pressure) is generated in the second tank 32 by the pressure adjustment unit 10.

In this state, ink runs down constantly from the first tank 31 to the second tank 32 via the ink head 2.

Therefore, the ink liquid level 61 of the first tank 31 becomes lower than a desired position over time, and the liquid level detection unit 42 turns OFF in due course.

On the other hand, the ink liquid level 62 of the second tank 32 comes to, or higher than a desired position, turning the liquid level detection unit 45 ON in due course.

Following the processes of the three STEPs described above, the control unit determines whether or not the liquid level detection unit 42 is OFF (the state in which the ink liquid level 61 has not reached a desired position), and, the liquid level detection unit 45 is ON (the state in which the ink liquid level 62 has reached a desired position) in STEP108.

The pump is activated or stopped in accordance with the detection for the liquid level detection unit 42 and the liquid level detection unit 45.

When the control unit determines in the judgment in STEP108 that the both conditions are not satisfied (NO in STEP108), it proceeds to STEP109. In STEP109, the pump 33 is stopped (if it has been stopped already, the state is maintained) and after that, the process proceeds to STEP111.

On the other hand, when the control unit determines in the judgment in STEP108 that the both conditions are satisfied (YES in STEP108), it proceeds to STEP110. In STEP110, the pump 33 is activated (if it has been activated already, the state is maintained) and after that, the process proceeds to STEP111.

In following STEP111, STEP112, STEP113, the operation to close or the operation to open the supply valve 63 is performed in accordance with the results (STEP111) of the detection of the liquid level detection unit 42 and the liquid level detection unit 45.

Specifically, first, the control unit determines whether or not the liquid level detection unit 42 is OFF and the liquid level detection unit 45 is OFF in STEP111.

When it is determined in the above judgment that the both conditions are satisfied (YES in STEP111), the process proceeds to STEP113. In STEP113, the supply valve 63 is opened (if it has been opened already, the state is maintained).

When the ink amount in the ink circulation path 4 decreases with printing and a pumping operation from the second tank 32 is performed by the pump, a state is generated in which the liquid level detection unit 45 turns OFF.

Then, if the detection conditions of the both liquid level detection units are satisfied, the supply valve 63 is opened, and ink in the ink cartridge 5 is supplied to the second tank 32. Accordingly, the ink amount in the second tank 32 increases, and the liquid level 62 returns to the normal position.

On the other hand, when it is determined that the both conditions are not satisfied (NO in STEP111), the process proceeds to STEP112. In STEP112, the supply valve 63 is closed (if it has been closed already, the state is maintained).

Thus, when the detection conditions of both the liquid level detection unit 42 and the liquid level detection unit 45 are not satisfied, the supply valve 63 enters the closed state, and ink supply to the second tank 32 is not performed.

After the process in STEP112 or the process in STEP113 described above is performed, the process proceeds to STEP114 in either case.

In STEP114, determination as to whether or not the ink-circulation operation is to be stopped (terminated) is performed.

When the control unit determines in the judgment described above to continue the ink circulation operation (NO in STEP114), it returns to STEP108, and repeats the processes of STEP108-STEP114.

On the other hand, when it is determined in the judgment mentioned above to terminate the ink-circulation operation, that is, when it is determined to move to the no ink-circulation (Yes in STEP114), the process proceeds to STEP201. In STEP201, the supply valve 63 is closed (if it has been closed already, the stat is maintained).

Further, in STEP202, the control unit stops the pump 33 (if it has been stopped already, the state is maintained).

In the following STEP203, the control unit waits until a predetermined time passes while maintaining the state set in STEP201 and STEP202, and after that, proceeds to STEP204. In STEP204, the atmosphere release valve 46 is closed, to shut off the inside of the first tank 31 from the atmosphere through the first air chamber 8.

The waiting time in STEP203 mentioned above reflects a consideration about the fact that the pump 33 does not stop immediately after the stop instruction is issued, because of inertia.

In the present embodiment, since the electromagnetic piston pump is used, the waiting time is set as a short period of time.

However, in a case of a gear pump that uses a DC motor as the driving source for example, the rotating operation of the pump does not stop after the stop instruction is issued because of inertial force. For this reason, the ink pumping operation to the first tank by the pump does not stop in a short period of time either.

If the atmosphere release valve 46 is closed in the state in which the ink pumping operation is not stopped (a state without any waiting time), the internal pressure of the first tank 31 increases with the pumped ink, and its influence may break the meniscus formed in the nozzle of the ink head 2.

On the other hand, if the waiting time is set long, ink in the first tank 31 runs down to the second tank 32 through the first path 40, decreasing the negative pressure in the second tank 32 gradually. As a result, the meniscus may be broken, and air bubbles may be entrapped in the first path 40 as ink in the first tank decreases.

Therefore, the waiting time is set with consideration for the time from the issuance of the instruction to stop the operation of the pump 33 until the ink pumping operation of the pump 33 actually stops. Specifically, the waiting time is set to a period of time with which it does not cause problems with the variation of the pressure applied to the nozzle of the ink head 2 and with the ink amount in the first tank 31. In this embodiment, the waiting time is set to 200 (msec), for example.

Meanwhile, with a motor with a brake function or with the separation of power using a clutch, the waiting time may be set to approximately zero second (no waiting time).

When the predetermined waiting time is over, the atmosphere release valve 46 is closed in STEP204 as described above, and next, the atmosphere release valve 54 is opened in STEP205. The second tank 32 communicates with the atmosphere with the release of the atmosphere release valve 54.

The operation of closing the atmosphere release valve 46 in STEP204 and the operation of opening the atmosphere release valve 54 in STEP205 described above are performed approximately at the same time or successively within a short period of time.

In other words, the internal pressure of the ink head 2 needs to be maintained at a pressure suitable for printing (in this embodiment, a negative pressure of approximately −1 kPa) even when the switching from the ink-circulation state to the no ink-circulation state is performed. Therefore, the switching is performed quickly.

That is, during the ink-circulation and during the no ink-circulation, the state of the atmosphere release valve 46 and the atmosphere release valve 54 are opposite. Then, by switching the open/close of the both atmosphere release valves 46 and 54 approximately at the same time or within a short period of time, the variation of the internal pressure of the ink head 2 is suppressed, preventing the meniscus formed in the nozzle from being broken.

Thus, by performing the switching quickly, the variation of the pressure applied to the nozzle indicated by the gauge pressure can be suppressed to very small amounts as illustrated in the range 71 and the range 73 in FIG. 7, making it possible to constantly maintain a negative pressure of approximately −1 kPa suitable for printing.

Meanwhile, when the atmosphere release valve 54 is opened, the inside of the bellows 51 of the pressure adjustment unit 10 also communicates with the atmosphere through the second shared air chamber 9. Accordingly, the bellows 51 expands by the weight of the weight 52 to the position at which it is supported by the bellows lifting and lowering mechanism 53.

With the processes until this point, the ink-circulation operation in the ink circulation path 4 is stopped, and the ink circulation path 4 enters the no ink-circulation state.

Next, in STEP206, the control unit moves the bellows lifting and lowering mechanism 53 to the standby position and make the pressure adjustment unit 10 enter the standby state.

The process in STEP206 is a process for making the pressure adjustment unit 10 enter the standby state so that when the next operation is executed, the ink-circulation operation is performed in a short period of time.

FIG. 9 is a table illustrating the operations of the respective units and their transition states during the ink-circulation operation in STEP108-STEP114 in FIG. 8. FIG. 9 shows the operation of the pump 33 and the operation of the supply valve 63 for each condition detected by the both liquid level detection unit during the ink-circulation operation.

The liquid level detection unit being OFF refers a state in which the ink liquid level in the tank has not reached a desired position. The liquid level detection unit being ON in refers to a state in which the ink liquid level in the tank has reached a desired position.

The pump being OFF refers to a state in which the pump is stopped and does not deliver ink. The pump being ON refers to a state in which the pump is activated and delivers ink.

The supply valve being OFF refers to a state in which the valve is closed and ink is not supplied. The supply valve being ON refers to a state in which the valve is open and ink is supplied.

In FIG. 9, when the liquid level detection unit 42 is OFF and the liquid level 45 is OFF, ink in the ink circulation path 4 is insufficient, so the pump 33 is turned OFF and the supply valve is turned ON.

Accordingly, the ink amount in the ink circulation path 4 increases, moving to the state in which the liquid level detection unit 42 is OFF and the liquid level detection unit 45 is ON.

When the liquid detection level 42 is turned OFF and the liquid level detection unit 45 is turned ON as described above, the supply valve 63 is turned OFF and the ink in the second tank 32 is delivered to the first tank.

If the ink amount in the ink circulation path 4 is still insufficient, transition to the state in which the liquid level detection unit 42 is OFF and the liquid level detection unit 45 is OFF as described above is performed.

If the ink amount in the ink circulation path 4 has reached a predetermined amount, transition to the state in which the liquid level detection unit 42 is ON and the liquid level detection unit 45 is ON, or the state in which the liquid level detection unit 42 is ON and the liquid level detection unit 45 is OFF is performed.

When the liquid level detection unit 42 is ON and the liquid level detection unit 45 is ON, the ink amount in the ink circulation path is sufficient, and the pump 33 is turned OFF and the supply valve 63 is turned OFF.

In addition, when the liquid level detection unit 42 is ON and the liquid level detection unit 45 is OFF, the ink amount in the ink circulation path is also sufficient, and the pump 33 is turned OFF and the supply valve 63 is turned OFF.

Thus, during the ink-circulation operation, the pump 33 and the supply valve 63 are controlled in accordance with signals from the both liquid level detection units 42 and 45.

While a line head (ink head 2) is used in the present embodiment, this is not a limitation, as long as the ink circulation path is configured so that the pressure applied to the ink head during the no ink-circulation period and the pressure applied to the ink head during the ink-circulation period are equal.

That is, the control of the ink-circulation described above can be applied in a similar way to a serial type ink head that performs scanning movement during image recording.

In this case, it is preferable to form the path from the first tank to the ink head and the path from the second tank to the ink head with a tube having elasticity and being flexible, for example a spiral tube and the like. This makes it possible for the ink head to perform recording while scanning on the recording medium.

While the pressure adjustment unit 10 consisting of the bellows, the weight and the bellows lifting and lowering mechanism for generating a negative pressure in the second tank 32 during the ink-circulation period, this is not a limitation.

That is, anything with which the pressure inside the second tank 32 can always be maintained at a constant negative pressure will do. Therefore, a method using a pump, a cylinder and the like may be used.

Second Embodiment

Figures 10A, 10B:
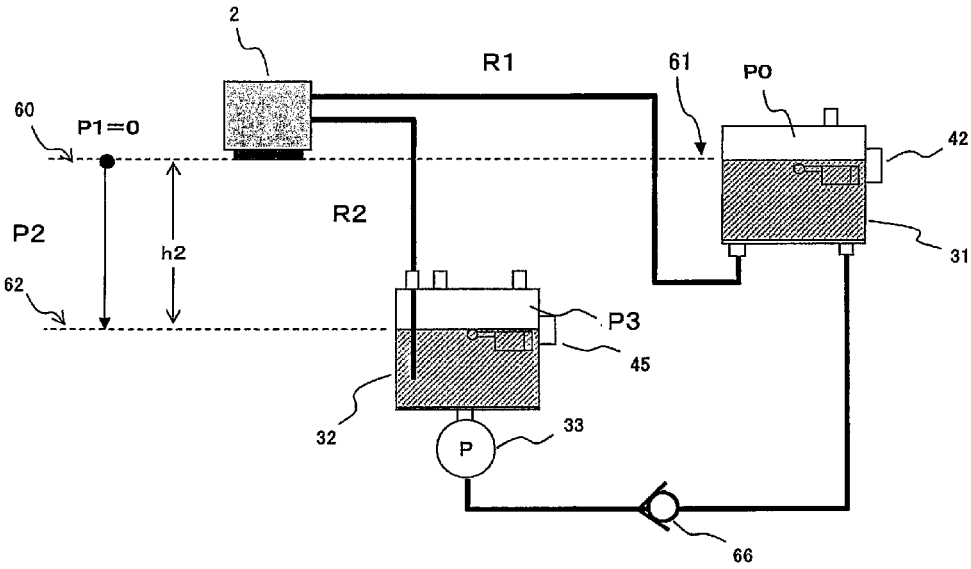
FIG. 10A is a diagram illustrating an arrangement example of the first tank and the second tank according to a second embodiment of the present invention.
FIG. 10B is a table illustrating an example in which the respective values are set so that the condition represented in an equation 3 is satisfied.

FIG. 10A is a diagram illustrating an arrangement example of the first tank and the second tank according to the second embodiment of the present invention. FIG. 10B is a table illustrating an example in which the respective values are set so that the condition represented in an equation 3 is satisfied. Meanwhile, the structures other than the ones illustrated in FIG. 10A are the same as those described in FIG. 1.

In the arrangement of the first tank and the second tank in the ink-jet printer in the second embodiment, as illustrated in FIG. 10A, the ink liquid level 61 of the first tank 31 is positioned at approximately the same height as the position of the nozzle face 60 in the gravitational direction. Therefore, water head differential pressure is not generated between the ink liquid level 61 of the first tank 31 and the nozzle face 60 (P1=0).

Therefore, the ink path may be configured to realize the relationship of, $$(P3/P2)=R2/R1 \qquad \text{equation 3}$$

for the pressure applied to the ink head 2 according to the equation 2 in the first embodiment described above.

The pressure applied to the nozzle during the no ink-circulation period is determined only by P2. In this embodiment, P2 is set to −1.0 kPa. Therefore, in order to set the pressure applied to the nozzle during the ink-circulation period to −1.0 kPa as well, P3, R1, R2 are set to satisfy the condition represented in the equation 3.

FIG. 10B is a table illustrating an example in which the respective values are set so as to satisfy the condition described above.

An example 6 in the table shows a case of P3/P2=R2/R1=2, and the values of P3, R1 and R2 are as in the table.

An example 7 in the table shows a case of P3/P2=R2/R11, and the values of P3, R1 and R2 are as in the table.

While P2 is set to be −1 kPa in this embodiment, the value is not limited to this, and the pressure may be set in accordance with the ink head 2.

Meanwhile, the switching from the no ink-circulation to the ink-circulation and the switching from the ink-circulation to the no ink-circulation are performed by the same processes as in the first embodiment.

According to this second embodiment, the ink liquid level 61 of the first tank 31 is positioned at approximately the same height as the nozzle face 60 in the gravitational direction. For this reason, even if the inside of the first tank 31 communicates with the atmosphere during the no ink-circulation period due to a machine trouble, ink leakage from the nozzle can be avoided or reduced.

This makes it possible to suppress the occurrence of dirt in the machine. In addition to it, the same effects as those of the first embodiment can be obtained.

Third Embodiment

Figures 11A, 11B:
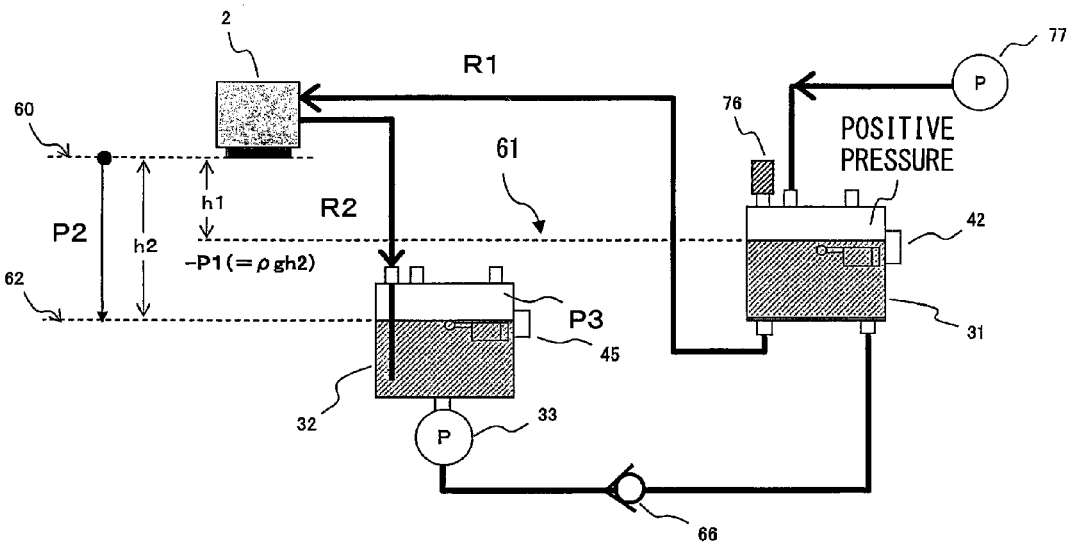
FIG. 11A is a diagram illustrating an arrangement example of the first tank and the second tank according to a third embodiment of the present invention.
FIG. 11B is a table illustrating an example in which the respective values are set so that the condition represented in an equation 5 is satisfied.

FIG. 11A is a diagram illustrating an arrangement example of the first tank and the second tank according to the third embodiment of the present invention. FIG. 11B is a table illustrating an example in which the respective values are set so that the condition represented in an equation 5 is satisfied. Meanwhile, the structures other than the ones illustrated in FIG. 11A are the same as those illustrated in FIG. 1.

Third Embodiment

In the arrangement of the first tank and the second tank in the ink-jet printer in the third embodiment, as illustrated in FIG. 11A, the ink liquid level 61 of the first tank 31 is positioned lower than the position of the nozzle face 60 in the gravitational direction.

In addition, to maintain the pressure P0 inside the first tank 31 at a constant positive pressure, a pump 77 as a pressure application unit, and a constant pressure valve 76 are disposed for the first tank 31.

The constant pressure valve 76 is set so as to keep a positive pressure desired to be maintained inside the first tank 31, during the ink-circulation period.

In addition, since the ink liquid level 61 of the first tank 31 is at a position lower than the position of the nozzle face 60 in the gravitational direction, a water head differential pressure P1 being a negative pressure is applied to the nozzle of the ink head 2.

The pressure applied to the nozzle during the no ink-circulation period and the pressure applied to the nozzle during the ink-circulation period are set to be equal also in this embodiment. That is, the ink circulation path 4 is configured to realize the relationship of $$P2=(P0+P1)-(1/(1+R2/R1))*(P0+P1-P2-P3) \quad \text{equation 4.}$$

In other words, modifying the equation 4, $$(P0+P1-P2)/(P0+P1-P2-P3)=R1/(R1+R2)$$

$$1/(1-(P3/(P0-P1-P2))=1/(1+R2/R1)$$

are obtained. Therefore, the ink circulation path 4 may be configured to realize the relation ship of $$-(P3/(P0+P1-P2))=R2/R1 \quad \text{equation 5.}$$

The pressure applied to the nozzle during the no ink-circulation period is determined only by P2. In this embodiment, P2 is set to −1.0 kPa.

Therefore, in order to set the pressure applied to the nozzle during the ink-circulation period to −1.0 kPa as well, P0, P1, P3, R1, R2 are set to satisfy the condition represented in the equation 5.

FIG. 11B shows, in a table, an example in which the respective values are set so as to satisfy the condition.

An example 8 in the table shows the respective values in a case in which the heights of the liquid levels of the first tank 31 and the second tank 32 are equal, and an example 9 in the table shows the respective values in a case in which the height of the liquid level of the second tank 32 is set lower than that of the first tank 31.

Figure 12:
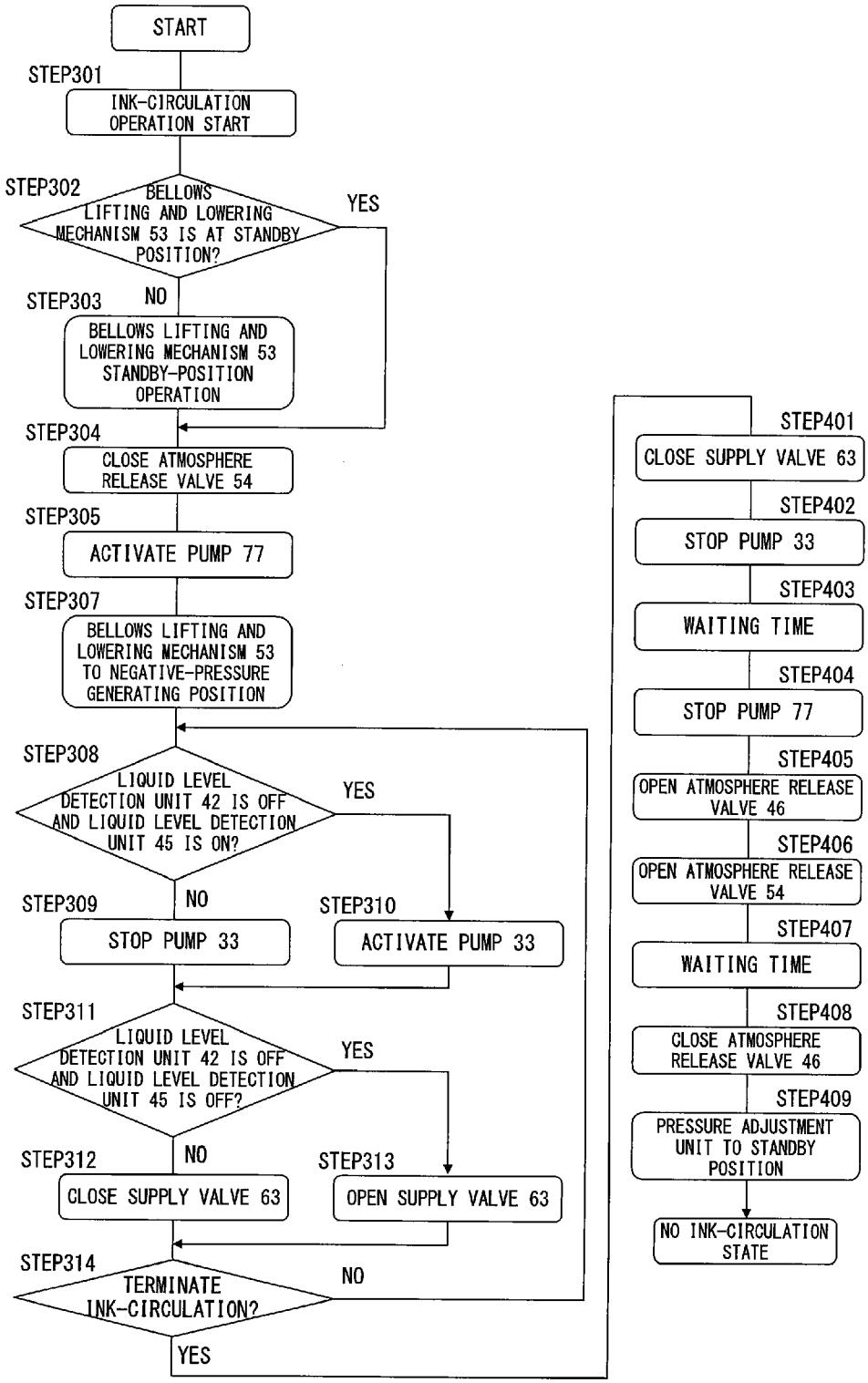
FIG. 12 is a flowchart describing the processing operations of the switching from the no ink-circulation to the ink-circulation, and the switching from the ink-circulation to the no ink-circulation in the ink-get printer according to the third embodiment of the present invention.

FIG. 12 is a flowchart describing the processing operations of the switching from the no ink-circulation to the ink-circulation, and the switching from the ink-circulation to the no ink-circulation in the configuration of the present embodiment illustrated in FIG. 11A and FIG. 11B.

The no ink-circulation state of the ink circulation path 4 is as described below.

The atmosphere release valve 46 is closed (shut off from the atmosphere). The atmosphere release valve 54 is open (communicating with the atmosphere). The pump 33 is stopped. The pump 77 is stopped. The supply valve 63 is closed. The pressure adjustment unit 10 is stopped (in the state in which the negative pressure generation is not performed). The ink-circulation is performed from this state (the no ink-circulation state or the standby state).

As described in FIG. 12, first, the instruction for starting the ink-circulation operation is issued by the control unit (STEP301).

In this process, the control unit issues an instruction (order) for the ink-circulation when air bubbles in the ink circulation path need to be removed, or when the machine is activated (the power is turned on), or immediately before printing starts, or when a predetermined period of time has passed, or when the temperature of ink deviates from a desired temperature range, and so on.

The control unit checks whether or not the bellows lifting and lowering mechanism 53 is at the standby position with the start instruction for the circulation operation (STEP302).

This check process is a process in which the control unit checks whether or not the pressure adjustment unit 10 required for generating a negative pressure in the second tank 32 is at the standby position.

That is, in the process, determination is made as to whether or not the bellows lifting and lowering mechanism 53 is in the state in which the bellows 51 is shrunk by the weight 52.

Meanwhile, the position of the bellows lifting and lowering mechanism 53 is determined by a position sensor which is not illustrated in the drawing. Then, when it is determined that the bellows lifting and lowering mechanism 53 is not at the standby position (NO in STEP302), the process proceeds to STEP303. In STEP303, the control unit moves the bellows lifting and lowering mechanism 53 to the standby position. This completes preparations for generating a negative pressure inside the second tank 32. After this, the control unit performs the process of STEP304.

On the other hand, when it is determined that the bellows lifting and lowering mechanism 53 is at the standby position (YES in STEP302), the process proceeds to STEP304.

In STEP304, the control unit shuts off the inside of the second tank 32 from the atmosphere through the second shared air chamber 9 by closing the atmosphere release valve 54.

Next, in STEP305, the control unit activates the pump 77. Accordingly, the pressure inside the first tank 31 increases to the pressure set with the constant pressure valve 76.

Next, in STEP307, the control unit moves the bellows lifting and lowering mechanism 53 from the standby position to the negative-pressure generating position, to generate a negative pressure in the second tank 32.

The operation of closing the atmosphere release valve 54 (STEP304), the operation of activating the pump 77 (STEP305) and the operation of moving the bellows lifting and lowering mechanism 53 to the negative-pressure generating position (STEP307) by the control unit described above are performed approximately at the same time or successively within a short period of time.

This is for suppressing the amount of variation of the internal pressures of the first tank 31 and the second tank 32 that occurs with the transition of ink in the ink circulation path 4 from a static state to a dynamic state.

When the three STEPs (STEP304, STEP305, STEP307) described above are performed, a positive pressure is applied inside the first tank 31 by the pump 77. In addition, a negative pressure is applied inside the second tank 32 by the pressure adjustment unit 10.

Description of the next processes of STEP308-STEP314 is omitted as they are the same as the processes of STEP108-STEP114 described in FIG. 8 for the embodiment 1 of the present invention.

When it is determined in STEP314 to terminate the ink-circulation operation, first, the control unit closes the supply valve 63 (if it has been closed already, the stat is maintained) in STEP401. Next, the control unit stops the operation of the pump 33 in STEP402 (when it has been stopped already, the state is maintained).

After the stop of the pump 33, the control unit waits for a predetermined time in STEP403, and when the predetermined time is over, stops the pump 77 in STEP404.

The waiting time (STEP403) is provided after the stop of the pump 33 (STEP402), reflecting a consideration about the fact that the pump 33 does not stop immediately after the stop instruction is issued by the control unit, because of inertia.

Next, the control unit opens the atmosphere release valve 46 in STEP405 to make the first tank 31 communicate with the atmosphere through the first shared air chamber 8.

Next, the control unit opens the atmosphere release valve 54 in STEP406 to make the second tank 32 communicate with the atmosphere through the second shared air chamber 9.

When the atmosphere release valve 54 is opened, the inside of the bellows 51 of the pressure adjustment unit 10 also communicates with the atmosphere through the second shared air chamber 9. Accordingly, the bellows 51 expands by the weight of the weight 52 to the position at which it is supported by the bellows lifting and lowering mechanism 53.

After the control unit has waited for the waiting time (STEP403), the operation of stopping the pump 77 (STEP404), the operation of opening the atmosphere release valve 46 (STEP405) and the operation of opening the atmosphere release valve 54 (STEP406) are performed approximately at the same time or successively within a short period of time.

Meanwhile, the control unit opens the atmosphere release valve 46 in order to once reset, to the atmospheric pressure, the pressure inside the first tank 31 that has been a positive pressure as a pressure has been applied by the pump 77.

In other words, it is for maintaining the pressure applied to the nozzle of the ink head 2 at a pressure suitable for printing (in this embodiment, a negative pressure of approximately −1 kPa) both in the ink-circulation state and in the no ink-circulation state.

After performing the process of STEP406, the control unit waits for a predetermined time in STEP407. By opening the atmosphere release valve 46 for a given time, the switching of the ink-circulation to the no ink-circulation can be performed quickly.

After step 407, the control unit closes the atmosphere release valve 46 (STEP408). Accordingly, the inside of the first tank 31 is shut off from the atmosphere. Then, by the water head differential pressure due to the difference in height between the ink liquid level 62 of the second tank 32 communicating with the atmosphere and the nozzle face 60, the pressure applied to the nozzle of the ink head 2 is maintained at a pressure with which printing can be performed.

Next, in STEP409, the control unit moves the bellows lifting and lowering mechanism 53 to the standby position and make the pressure adjustment unit 10 enter the standby state. This process in STEP409 is a process for making the pressure adjustment unit 10 enter the standby state so that when the next operation is executed, the ink-circulation operation is performed in a short period of time.

Meanwhile, while the pump 77 and the constant pressure valve 76 are used as the measure for maintaining the inside of the first tank 31 at a positive pressure, this is not a limitation, as long as the inside of the first tank 31 is maintained at a positive pressure. For example, methods such as a pressure application methods using shrinkage of a balloon, expansion and shrinkage of a bellows, or using a spring, may be applied.

In addition, the present invention is not limited to the embodiments described above, and at the implementation stage, various modifications can be made without departing from its spirit and scope.

What is claimed is:

1. An ink-jet printer comprising:

an ink circulation path comprising:

an ink head having a nozzle face on which a plurality of nozzles are formed and discharging an ink from the nozzles in accordance with an image signal to perform a printing process on a recording medium;

a first tank disposed so that a liquid level of ink stored in the first tank is on a same level as, or higher than, the nozzle face of the ink head in a gravitational direction, and being able to communicate with an atmosphere or to be shut off from the atmosphere;

a second tank disposed so that a liquid level of ink stored in the second tank is lower than the nozzle face of the ink head in the gravitational direction, and being able to communicate with the atmosphere or to be shut off from the atmosphere; and a pump sending the ink in the second tank to the first tank;

a pressure adjustment unit applying, when the second tank is shut off from the atmosphere, a negative pressure to the second tank, wherein the ink circulation path makes the first tank communicate with the atmosphere and shuts off the second tank from the atmosphere in an ink-circulation state period in which the ink is circulated, and shuts off the first tank from the atmosphere and makes the second tank communicate with the atmosphere in a no ink-circulation state period in which the ink is not circulated; and during the printing process, the ink-circulation state and the no ink-circulation state are switched.

2. The ink-jet printer according to claim 1, wherein the switching between the ink-circulation state and the no ink-circulation state is performed when air bubbles in the ink circulation path need to be removed, or when a temperature of the ink deviates from a desired temperature range, or when a preset given time has passed.

3. The ink-jet printer according to claim 2, wherein the ink circulation path is configured so that a pressure applied to the ink head in the ink-circulation state period and a pressure applied to the ink head in the no ink-circulation state period are within a range of pressures in the ink head with which printing can be performed.

4. The ink-jet printer according to claim 3, wherein the pressure applied to the ink head in the no ink-circulation state period is determined by a negative pressure generated by a difference in height between the liquid level of the second tank and the nozzle face; and the pressure applied to the ink head in the ink-circulation state period is determined by a positive pressure generated by a difference in height between the liquid level of the first tank and the nozzle face, the negative pressure generated by the difference in height between the liquid level of the second tank and the nozzle face, the negative pressure applied by the pressure adjustment unit, a flow path resistance from the first tank to the ink head, and a flow path resistance from the ink head to the second tank.

5. The ink-jet printer according to claim 4, wherein the negative pressure applied by the pressure adjustment unit in the ink-circulation state period is larger than the negative pressure generated by a difference in height between the liquid level of the second tank and the nozzle face.

6. The ink-jet printer according to claim 4, wherein the ink circulation path is configured to satisfy $$-(P3/(P1-P2))=R2/R1, \text{ when:}$$

a water head differential pressure being the positive pressure generated by the difference in height between the liquid level of the first tank and the nozzle face is P1;

a water head differential pressure being the negative pressure generated by the difference in height between the liquid level of the second tank and the nozzle face is P2;

a pressure being the negative pressure applied to the second tank by the pressure adjustment unit is P3;

the flow path resistance from the first tank to the ink head is R1; and the flow path resistance from the ink head to the second tank is R2.

7. The ink-jet printer according to claim 1, wherein the ink circulation path is configured so that a pressure applied to the ink head in the ink-circulation state period and a pressure applied to the ink head in the no ink-circulation state period are within a range of pressures in the ink head with which printing can be performed.

8. The ink-jet printer according to claim 7, wherein the pressure applied to the ink head in the no ink-circulation state period is determined by a negative pressure generated by a difference in height between the liquid level of the second tank and the nozzle face; and the pressure applied to the ink head in the ink-circulation state period is determined by a positive pressure generated by a difference in height between the liquid level of the first tank and the nozzle face, the negative pressure generated by the difference in height between the liquid level of the second tank and the nozzle face, the negative pressure applied by the pressure adjustment unit, a flow path resistance from the first tank to the ink head, and a flow path resistance from the ink head to the second tank.

9. The ink-jet printer according to claim 8, wherein the ink circulation path is configured to satisfy $$-(P3/(P1-P2))=R2/R1, \text{ when:}$$

a water head differential pressure being the positive pressure generated by the difference in height between the liquid level of the first tank and the nozzle face is P1;

a water head differential pressure being the negative pressure generated by the difference in height between the liquid level of the second tank and the nozzle face is P2;

a pressure being the negative pressure applied to the second tank by the pressure adjustment unit is P3;

the flow path resistance from the first tank to the ink head is R1; and the flow path resistance from the ink head to the second tank is R2.

10. The ink-jet, printer according to claim 8, wherein the negative pressure applied by the pressure adjustment unit in the ink-circulation state period is larger than the negative pressure generated by a difference in height between the liquid level of the second tank and the nozzle face.

11. The ink-jet printer according to claim 1, wherein the negative pressure applied by the pressure adjustment unit in the ink-circulation state period is larger than a negative pressure generated by a difference in height between the liquid level of the second tank and the nozzle face.

12. The ink-jet printer according to claim 1, wherein the ink circulation path is configured to satisfy $$-(P3/(P1-P2))=R2/R1, \text{ when:}$$

a water head differential pressure being a positive pressure generated by a difference in height between the liquid level of the first tank and the nozzle face is P1;

a water head differential pressure being a negative pressure generated by a difference in height between the liquid level of the second tank and the nozzle face is P2;

a pressure being the negative pressure applied to the second tank by the pressure adjustment unit is P3;

a flow path resistance from the first tank to the ink head is R1; and a flow path resistance from the ink head to the second tank is R2.

13. An ink-jet printer comprising:

an ink circulation path comprising an ink head having:

a nozzle face on which a plurality of nozzles are formed and discharging an ink from the nozzles in accordance with an image signal to perform a printing process on a recording medium;

a first tank disposed so that a liquid level of ink stored in the first tank is lower than the nozzle face of the ink head in a gravitational direction, and being able to communicate with an atmosphere or to be shut off from the atmosphere;

a second tank disposed so that a liquid level of ink stored in the second tank is lower than the nozzle face of the ink head in the gravitational direction, and being able to communicate with the atmosphere or to be shut off from the atmosphere; and a pump sending the ink in the second tank to the first tank;

a pressure application unit applying, when the first tank is shut off from the atmosphere, a positive pressure to an inside of the first tank; and a pressure adjustment unit applying, when the second tank is shut off from the atmosphere, a negative pressure to the second tank, wherein the ink circulation path shuts off the first tank from the atmosphere and shuts off the second tank from the atmosphere in an ink-circulation state period in which the ink is circulated, and shuts off the first tank from the atmosphere and makes the second tank communicate with the atmosphere in a no ink-circulation state period in which the ink is not circulated; and during the printing process, the ink-circulation state and the no ink-circulation state are switched.

14. The ink-jet printer according to claim 13, wherein the switching between the ink-circulation state and the no ink-circulation state is performed when air bubbles in the ink circulation path need to be removed, or when a temperature of the ink deviates from a desired temperature range, or when a preset given time has passed.

15. The ink-jet printer according to claim 13, wherein the ink circulation path is configured so that a pressure applied to the ink head in the ink-circulation state period and a pressure applied to the ink head in the no ink-circulation state period are within a range of pressures in the ink head with which printing can be performed.

16. The ink-jet printer according to claim 15, wherein the pressure applied to the ink head in the no ink-circulation state period is determined by a negative pressure generated by a difference in height between the liquid level of the second tank and the nozzle face; and the pressure applied to the ink head in the ink-circulation state period is determined by the positive pressure applied by the pressure application unit, a negative pressure generated by a difference in height between the liquid level of the first tank and the nozzle face, the negative pressure generated by the difference in height between the liquid level of the second tank and the nozzle face, the negative pressure applied by the pressure adjustment unit, a flow path resistance from the first tank to the ink head, and a flow path resistance from the ink head to the second tank.

17. The ink-jet printer according to claim 16, wherein the ink circulation path is configured to satisfy $$-(P3/(P1-P2))=R2/R1, \text{ when:}$$

a pressure being the positive pressure applied to the first tank by the pressure application unit is P0;

a water head differential pressure being the negative pressure generated by the difference in height between the liquid level of the first tank and the nozzle face is P1;

a water head differential pressure being the negative pressure generated by the difference in height between the liquid level of the second tank and the nozzle face is P2;

a pressure being the negative pressure applied to the second tank by the pressure adjustment unit is P3;

the flow path resistance from the first tank to the ink head is R1; and the flow path resistance from the ink head to the second tank is R2.

* * * * *